US010745779B1

(12) United States Patent
McDevitt et al.

(10) Patent No.: US 10,745,779 B1
(45) **Date of Patent: *Aug. 18, 2020**

(54) WROUGHT MACHINABLE BRASS ALLOY

(71) Applicant: Chase Brass and Copper Company, LLC, Montpelier, OH (US)

(72) Inventors: David Dean McDevitt, Angola, IN (US); Charles Lawrence Muller, Wauseon, OH (US)

(73) Assignee: WIELAND CHASE, LLC, Montpelier, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/274,002

(22) Filed: Feb. 12, 2019

Related U.S. Application Data

(63) Continuation of application No. 15/918,618, filed on Mar. 12, 2018, now Pat. No. 10,358,696, which is a continuation-in-part of application No. 14/817,191, filed on Aug. 3, 2015, now Pat. No. 9,951,400, which is a continuation of application No. 14/493,164, filed on Sep. 22, 2014, now abandoned.

(60) Provisional application No. 61/937,464, filed on Feb. 7, 2014.

(51) Int. Cl.
*C22C 9/04* (2006.01)

(52) U.S. Cl.
CPC ..... *C22C 9/04* (2013.01)

(58) Field of Classification Search
CPC ..... C22C 9/04
USPC ..... 420/479
See application file for complete search history.

(56) References Cited

U.S. PATENT DOCUMENTS 9,951,400 B1 * 4/2018 McDevitt ..... C22C 9/04
10,358,696 B1 * 7/2019 McDevitt ..... C22C 9/04

* cited by examiner

*Primary Examiner* — Jie Yang
(74) *Attorney, Agent, or Firm* — Harness, Dickey & Pierce, PLC

(57) ABSTRACT

A wrought machinable low copper, silicon, zinc alloy having a copper content between about 66 weight percent and about 69 weight percent and wherein the silicon content is between about 1.53 weight percent and about 2.0 weight percent.

7 Claims, 33 Drawing Sheets

Figure 1 - Compositions Evaluated
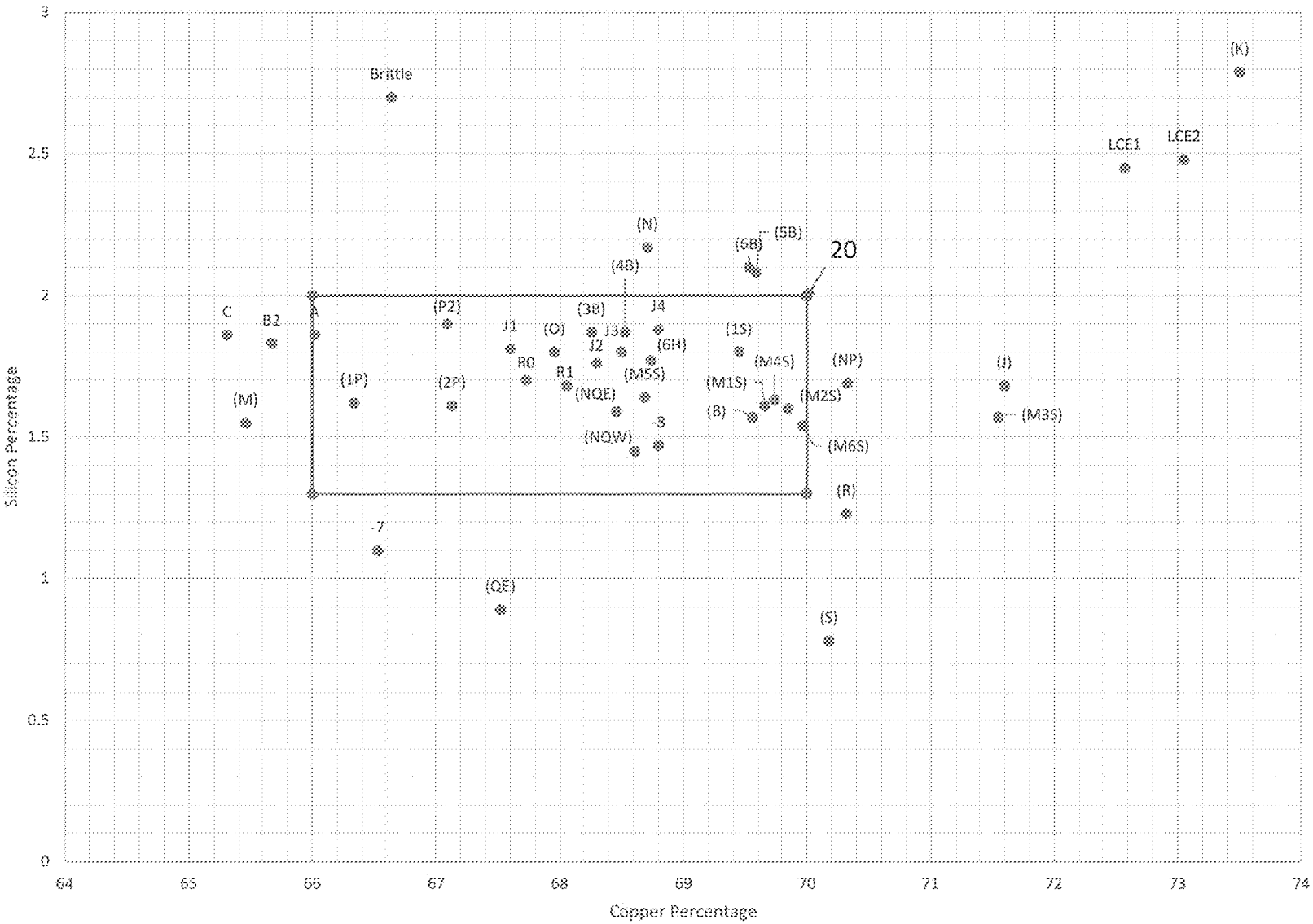

Figure 1A - Compositions Evaluated
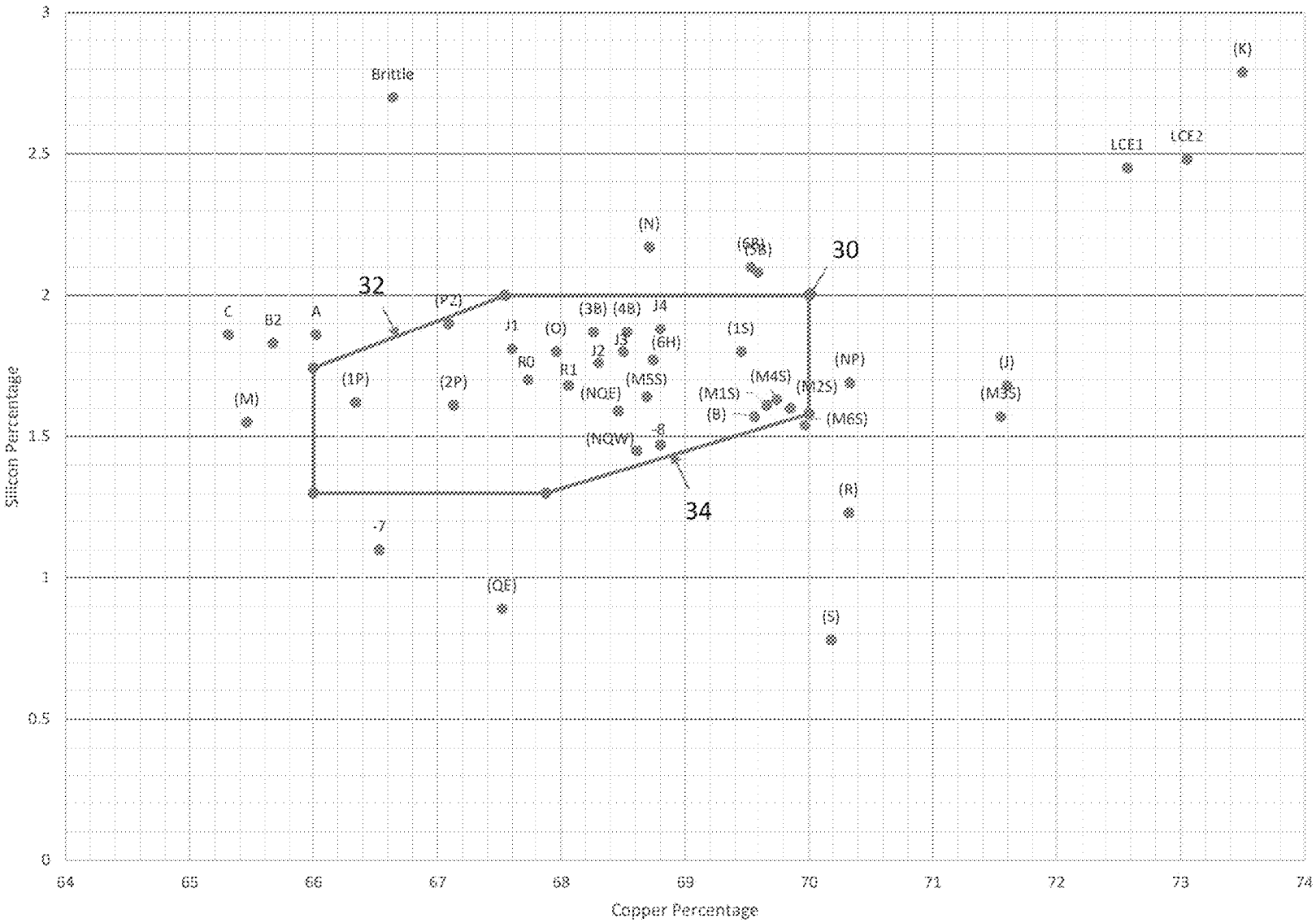

Figure 3 - ISO 6509 Corrosion Depth (µm)
Silicon Percent
Copper Percentage
0
0.5
1
1.5
2
2.5
3
64
65
66
67
68
69
70
71
72
73
74

Figure 4 - Elongation (%)
Silicon Percentage
Copper Percentage
3
2.5
2
1.5
1
0.5
0
64
65
66
67
68
69
70
71
72
73
74
20.8
39.4
42.7
56
32.8
35.7
36.4
38.6
50.7
47.9
29.7
20.1
35.5
36.1
35.2
7.1
27.7
14.9
31
31.9
35.7
34.9
19.4
19.6
26
26.1
40.3
10.2
22.4
35.9
19.1
12.9
17.5
11.2
12.5

WROUGHT MACHINABLE BRASS ALLOY

CROSS-REFERENCED APPLICATION

This application is a continuation-in-part application which claims priority to U.S. application Ser. No. 15/918,618, filed Mar. 12, 2018, which claims priority to U.S. application Ser. No. 14/817,191, filed Aug. 3, 2015, which claims priority to U.S. application Ser. No. 14/493,164 filed on Sep. 22, 2014, which claims priority to U.S. Provisional Application Ser. No. 61/937,464 filed on Feb. 7, 2014, the disclosures of which are incorporated by reference in their entirety.

FIELD

The present disclosure relates to wrought copper alloys, and in particular to low copper, machinable brass alloys, with low or no lead.

BACKGROUND

This section provides background information related to the present disclosure which is not necessarily prior art.

Lead is a common ingredient in copper alloys to improve their machinability. Typical lead contents in machinable brass alloys range from about 1 to about 6 percent (by weight). Because of their excellent machinability, these lead-containing copper alloys have been an important basic material for a variety of articles such as water faucets, and supply/drainage metal fittings and valves.

However, the application of these lead-containing alloys has been limited in recent years, because the lead contained therein is believed to be an environmental pollutant harmful to humans. One aspect is the lead contained in metallic vapor that is generated in the manufacturing and processing of these alloys at high temperatures, such as in melting and casting operations. Another aspect is the concern that lead contained in water system metal fittings, valves, and other components made of those alloys will dissolve out into the water supply.

For these and other reasons, many countries have been reducing the permissible levels of lead in plumbing fixtures. While there are a number of copper alloys that can be used, most of these alloys are very difficult or expensive to machine into satisfactory plumbing parts. Various attempts have been made to provide copper alloys with improved machinability for these applications. One good example of such an alloy is C87850, which has a nominal composition of 74 78 weight percent copper, up to 0.1 weight percent antimony, up to 0.1 weight percent iron, up to 0.09 weight percent lead, up to 0.1 weight percent manganese, up to 0.2 weight percent nickel, between 0.05 and 0.2 weight percent phosphorus, between 2.7 and 3.4 weight percent silicon, up to 0.3 weight percent tin, and the balance zinc. Several patents cover C87850 and related alloys, including U.S. Pat. Nos. 6,413,330, 7,056,396, and 7,883,589. These patents teach that for copper contents <70 weight percent "the addition of less than 2.0 percent, by weight, of silicon cannot form a gamma phase sufficient to provide industrially satisfactory machinability." They further teach that a minimum copper content of about 69 weight percent is needed to provide a satisfactory alloy.

While these alloys provide excellent properties for plumbing and other applications, are readily machinable, and they include little to no lead, these alloys can be relatively expensive to manufacture.

SUMMARY

This section provides a general summary of the disclosure, and is not a comprehensive disclosure of its full scope or all of its features.

Alloys of the present invention likewise provide excellent properties for plumbing and other applications, are readily machinable, and they likewise include little to no lead. However, unlike the prior art machinable copper alloys with little to no lead, these alloys have reduced copper and silicon contents and are therefore less expensive than the well-known prior art machinable copper alloys which contain more copper and less zinc.

Generally, embodiments of this invention provide wrought products of a machinable low lead, low copper, silicon, zinc alloy. In a preferred embodiment the alloy comprises between about 66 and about 69 weight percent copper, and the silicon content is between about 1.5 weight percent and about 2.0 weight percent, and the balance comprises primarily zinc, and unavoidable impurities. In some preferred embodiments the alloy comprises between about 66 and about 69 weight percent copper, and the silicon content is between about 1.5 weight percent and about 2.0 weight percent, and the balance comprises primarily zinc, and unavoidable impurities.

In a further preferred embodiment the Si content further satisfies the relationship: $0.167*Cu-9.28>Si>0.132*Cu-7.66$.

Some embodiments can contain additional elements, including up to about 0.15 weight percent phosphorus, up to about 0.5 weight percent iron, up to about 1.2 weight percent tin, up to about 2.5 weight percent aluminum, up to about 0.25 weight percent nickel, up to about 0.25 weight percent cobalt, up to about 0.25 weight percent manganese, up to about 0.15 weight percent arsenic, up to about 0.15 weight percent antimony, up to about 0.25 weight percent bismuth, up to about 0.25 weight percent selenium, and up to 0.25 weight percent sulfur.

In other embodiments the alloying elements can include up to about 0.25 weight percent lead; up to about 0.15 weight percent phosphorus; up to about 0.5 weight percent iron; up to about 1.2 weight percent tin; up to about 2.5 weight percent aluminum; up to about 0.25 weight percent nickel; up to about 0.25 weight percent cobalt; up to about 0.15 weight percent arsenic; up to about 0.15 weight percent antimony; up to about 0.25 weight percent bismuth; up to about 0.25 weight percent selenium; up to 0.25 weight percent sulfur; and at least one of: up to 0.4 tellurium; up to 0.1 weight percent zirconium; up to 0.2 weight percent magnesium; up to 0.2 weight percent chromium; and at least one of: up to 0.1 weight percent lithium; up to 0.2 weight percent boron; and up to about 0.5 weight percent mischmetal; and the balance zinc and unavoidable impurities.

In still other embodiments the alloying elements can include any of the aforementioned and/or additional elements in minor quantities, e.g., <0.1 weight percent that do not substantially affect the basic and novel properties of the alloy, namely machinability and/or corrosion resistance.

In some embodiments there is only one of tin and aluminum. In other embodiments, there is only a nominal amount of both tin and aluminum.

The alloy is preferably corrosion resistant, and preferably has corrosion penetration ≤200 μm when tested according to ISO 6509 Protocol, and more preferably ≤100 μm tested according to ISO 6509 Protocol.

The alloy preferably has a tensile strength of at least about 55 ksi as determined according to ASTM E8, and more preferably at least about 65 ksi as determined according to ASTM E8. The alloy preferably has a yield strength of at least 20 ksi as determined according to ASTM E8, and more preferably at least 30 ksi as determined according to ASTM E8. The alloy preferably has a surface hardness (Rockwell B) of at least 55 as determined according to ASTM E18. The alloy preferably has intermediate ductility with an elongation less than about 47% as determined according to ASTM E8, and more preferably less than about 43% as determined according to ASTM E8.

The alloy preferably has microstructure that comprises alpha phase, and non-alpha phases in an amount such that the elongation is greater than about 8% as determined according to ASTM E8.

In some embodiments the alloy microstructure preferably comprises at least about 3 volume percent non-alpha phases. In other embodiments alloy microstructure comprises a majority of alpha phase, with between about 3% and about 45% non-alpha phases, and more preferably between about 5% and about 30% non-alpha phase.

The composition and the microstructure are preferably such that the chips resulting from the machining of the alloy break readily into smaller pieces conducive to high speed machining.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a copper vs. silicon diagram illustrating the compositions of the preferred embodiment;

FIG. 1A is a copper vs. silicon diagram similar to FIG. 1, illustrating compositions of a further preferred embodiment;

Corresponding reference numerals indicate corresponding parts throughout the several views of the drawings.

DETAILED DESCRIPTION

Figure 2:
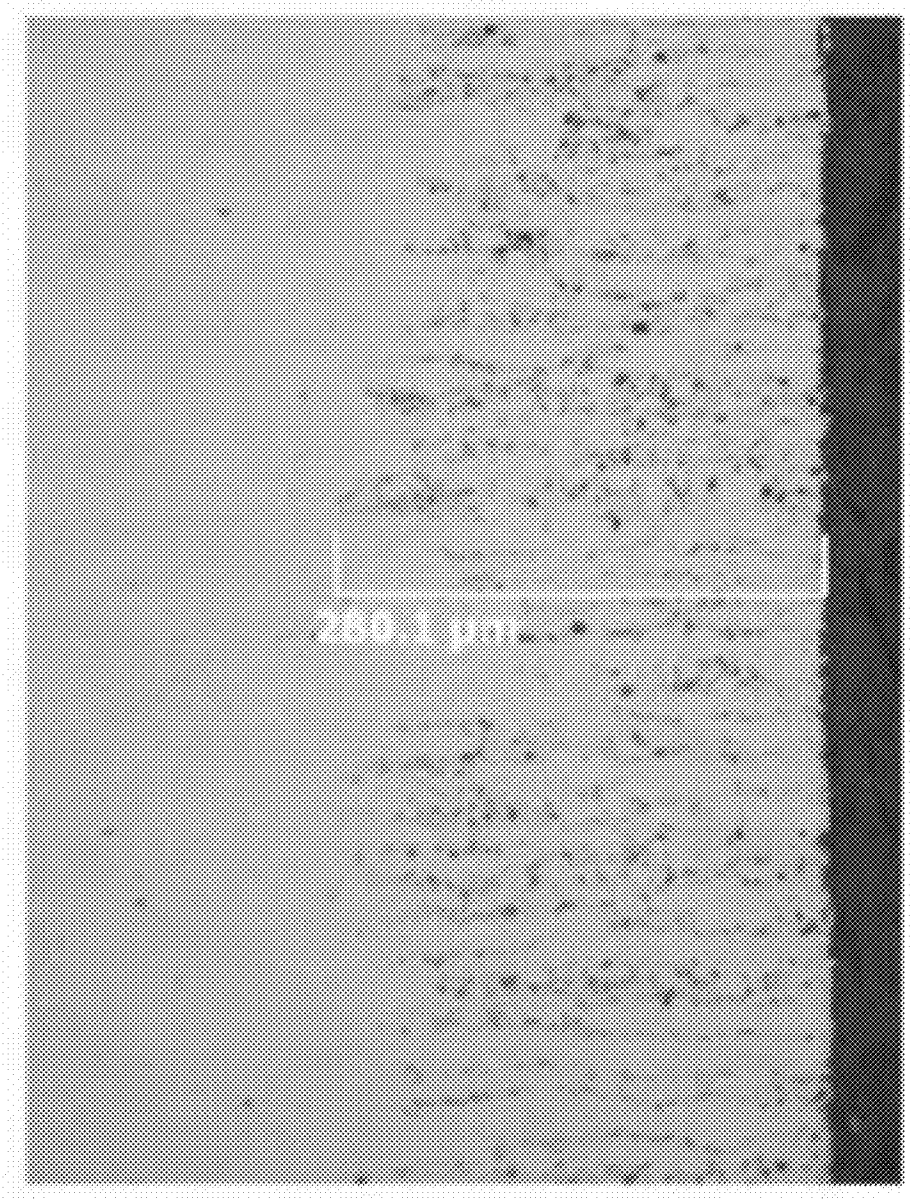
FIG. 2 is a photomicrograph showing an alloy that failed the NSF 14-2012 corrosion requirement.

Example embodiments will now be described more fully with reference to the accompanying drawings.

The composition of a first preferred embodiment of a wrought, machinable, low lead, low copper, silicon, zinc alloy is shown in FIG. 1 as having a copper content of between about 66 weight percent and about 70 weight percent, and a silicon content of between about 1.3 weight percent and about 2.0 weight percent, the balance being primarily zinc with unavoidable impurities, and optional alloying elements as described below.

This composition is identified generally as 20 in FIG. 1. The inventors' data indicates that alloys that have copper greater than about 66 weight percent, and silicon greater than about 1.3 weight percent generally are resistant to de-zincification corrosion and consequently pass NSF 14-2012 ISO 6509 requirements, and are preferred. The inventors' data indicates that alloys below about 2 weight percent silicon generally have sufficient ductility to aid mill processing and are preferred. The inventors' data further indicates that alloys above about 1.3 weight percent silicon (and more preferably above about 1.5 weight percent silicon) and below about 70 weight percent copper (and more preferably below about 69 weight percent copper), generally limit ductility sufficiently to machine well, as the resulting chips break into smaller pieces and are preferred.

The composition of a second preferred embodiment of a wrought, low lead, low copper, silicon, zinc alloy is shown in FIG. 1A. The composition of FIG. 1A has a copper content of between about 66 weight percent and about 70 weight percent (and more preferably between about 66 weight percent and about 69 weight percent), and a silicon content of between about 1.3 weight percent and about 2.0 weight percent (and more preferably between about 1.5 weight percent and about 2.0 weight percent), the balance being primarily zinc with unavoidable impurities, and optional alloying elements as described below.

In addition, the composition of a second preferred embodiment of the alloy is preferably below line 32, given by the equation Si=0.167*Cu−9.28. The composition of the alloy is preferably above line 34, given by the equation Si=0.132*Cu−7.66. Thus, the area composition is represented as 30 in FIG. 1A, with between about 66 and about 70 weight percent copper, between about 1.3 weight percent and about 2.0 weight percent silicon, the balance comprising primarily zinc, and unavoidable impurities or specified alloying elements, and the Si content further satisfies the relationship: 0.167*Cu−9.28>Si>0.132*Cu-7.66.

In alternative embodiments, the copper content is less than about 69 weight percent. In other alternative embodiments the silicon content is greater than 1.5 weight percent. In still other alternative embodiments, the copper content is less than about 69 weight percent and the silicon content is greater than 1.53 weight percent.

Table 1 Example Compositions (Material in form of extruded rod, except as noted)

TABLE 1

Compositions Evaluated

| ID | Cu | Si | Pb | Fe | Sn | Ni | P | Zn |
|---|---|---|---|---|---|---|---|---|
| (K) | 73.50 | 2.79 | 0.079 | 0.043 | 0.012 | 0.004 | 0.084 | 23.44 |
| LCE2 | 73.05 | 2.48 | 0.04 | 0.045 | — | 0.004 | 0.093 | 24.29 |
| LCE1 | 72.57 | 2.45 | 0.04 | 0.046 | 0.004 | 0.004 | 0.091 | 24.8 |
| (J) | 71.60 | 1.68 | 0.104 | 0.043 | 0.02 | 0.007 | 0.059 | 26.48 |
| (B) | 69.56 | 1.57 | 0.089 | 0.044 | 0.018 | 0.006 | 0.063 | 28.64 |
| −8 | 68.80 | 1.47 | 0.106 | 0.037 | 0.039 | 0.006 | 0.068 | 29.47 |
| −7 | 66.53 | 1.10 | 0.117 | 0.033 | 0.037 | 0.007 | 0.063 | 32.1 |
| (R) | 70.32 | 1.23 | 0.084 | 0.049 | 0.034 | 0.007 | 0.072 | 28.19 |
| (S) | 70.18 | 0.78 | 0.084 | 0.050 | 0.048 | 0.007 | 0.07 | 28.76 |
| (U) | 75.51 | 1.84 | 0.073 | 0.042 | 0.038 | 0.006 | 0.074 | 22.41 |
| (M) | 65.46 | 1.55 | 0.094 | 0.048 | 0.017 | 0.005 | 0.067 | 32.76 |
| (N) | 68.71 | 2.17 | 0.083 | 0.043 | 0.013 | 0.005 | 0.073 | 28.89 |
| (O) | 67.96 | 1.80 | 0.094 | 0.047 | 0.015 | 0.005 | 0.073 | 30.00 |
| Brittle | 66.64 | 2.70 | 0.076 | | | | 0.072 | ~30.50 |
| (QE) | 67.52 | 0.89 | 0.095 | 0.068 | 0.071 | 0.011 | 0.032 | 31.3 |
| (NQW) | 68.61 | 1.45 | 0.044 | 0.030 | 0.014 | 0.002 | 0.015 | 29.82 |
| (NQE) | 68.46 | 1.59 | 0.033 | 0.027 | <0.01 | 0.001 | 0.013 | 28.85 |
| (6H) | 68.74 | 1.77 | 0.056 | 0.033 | 0.016 | 0.002 | 0.113 | 29.26 |
| (1S) | 69.45 | 1.80 | 0.061 | 0.037 | 0.025 | 0.004 | 0.095 | 28.52 |
| (P2) | 67.09 | 1.90 | 0.058 | 0.028 | 0.010 | 0.002 | 0.091 | 30.80 |
| (1P) | 66.34 | 1.62 | 0.050 | 0.036 | <0.010 | 0.002 | 0.076 | 31.85 |
| (2P) | 67.13 | 1.61 | 0.032 | 0.030 | <0.010 | 0.001 | 0.077 | 31.09 |
| (3B) | 68.26 | 1.87 | 0.040 | 0.033 | <0.010 | <0.001 | 0.090 | 29.69 |
| (4B) | 68.53 | 1.87 | 0.040 | 0.033 | <0.010 | <0.001 | 0.090 | 29.42 |
| (5B) | 69.59 | 2.08 | 0.023 | 0.026 | <0.010 | <0.001 | 0.117 | 28.14 |
| (6B) | 69.53 | 2.10 | 0.023 | 0.027 | <0.010 | <0.001 | 0.117 | 28.18 |
| (NP) | 70.33 | 1.69 | 0.031 | 0.027 | <0.010 | 0.001 | 0.012 | 27.88 |
| (M1S) | 69.66 | 1.61 | 0.220 | 0.030 | 0.010 | 0.001 | 0.012 | 28.32 |
| (M2S) | 69.85 | 1.60 | 0.030 | 0.300 | 0.010 | 0.001 | 0.022 | 28.18 |
| (M3S) | 71.55 | 1.57 | 0.030 | 0.030 | 0.390 | 0.001 | 0.016 | 26.39 |
| (M4S) | 69.74 | 1.63 | 0.060 | 0.060 | 0.010 | 0.002 | 0.014 | 28.31 |

TABLE 1-continued

Compositions Evaluated

| ID | Cu | Si | Pb | Fe | Sn | Ni | P | Zn |
|---|---|---|---|---|---|---|---|---|
| (M5S) | 68.69 | 1.64 | 0.030 | 0.030 | 0.020 | 0.001 | 0.013 | 28.74 |
| (M6S) | 69.97 | 1.54 | 0.010 | 0.050 | 0.010 | 0.012 | 0.013 | 28.09 |
| R0 | 67.73 | 1.70 | 0.050 | 0.029 | <0.002 | 0.016 | 0.100 | Rem. |
| R1 | 68.06 | 1.68 | 0.040 | 0.031 | <0.002 | 0.008 | 0.073 | Rem. |

Notes
M1S -Al 0.014%, As 0.120%
M4S - As 0.115%, Co 0.099%, Mn 0.089%
M5S - Al 0.825%,
M6S - As 0.005%, Bi 0.133%, Mn 0.031%, Sb 0.093%, Se 0.004%, Te 0.034%
R0 - Mg 0.0002%
R1 - Mn 0.035%, Mg 0.0035%, Zr 0.005%

TABLE 1A

Hot Rolled Plate Compositions Evaluated

| ID | Cu | Si | Pb | Fe | Sn | Ni | P | Zn |
|---|---|---|---|---|---|---|---|---|
| A | 66.02 | 1.86 | 0.070 | 0.005 | <0.010 | <0.001 | 0.102 | Rem. |
| B2 | 65.67 | 1.83 | 0.049 | 0.004 | <0.010 | <0.001 | 0.110 | Rem. |
| C | 65.31 | 1.86 | 0.071 | 0.004 | <0.010 | <0.001 | 0.100 | Rem. |
| J1 | 67.60 | 1.81 | 0.019. | 0.002 | <0.010 | <0.001 | 0.019 | Rem. |
| J2 | 68.30 | 1.76 | 0.027 | 0.003 | <0.010 | <0.001 | 0.027 | Rem. |
| J3 | 68.50 | 1.80 | 0.028 | 0.038 | <0.010 | <0.001 | 0.028 | Rem. |
| J4 | 68.80 | 1.88 | 0.022 | 0.006 | <0.010 | <0.001 | 0.027 | Rem. |

Notes
A - Mg 0.0003%, Cr 0.055% (~½" thick)
B2 - Mg 0.0002%, (~½" thick)
C - Mg 0.0003%, Mn 0.243% (~½" thick)
J1 - Base Composition (~0.080" thick)
J2 - Li 0.11% (~0.080" thick)
J3 - Mischmetal 0.109% (~0.080" thick)
J4 - B 0.0155% (~0.080" thick)

Corrosion Properties

Corrosion testing was performed to determine conformance to NSF 14-2012 requirements of a maximum depth of penetration to be less than 200 μm on testing per the ISO 6509 protocol. The results are summarized in Tables 2 and 2A.

TABLE 2

Corrosion Properties

| ID | Cu | Si | P | Max. Depth Long. | Max. Depth Trans. | Avg. Depth Long. | Avg. Depth Trans. |
|---|---|---|---|---|---|---|---|
| (K) | 73.50 | 2.79 | 0.084 | 30 | 40 | 10 | 20 |
| LCE2 | 73.05 | 2.48 | 0.093 | 20 | 20 | 20 | <10 |
| LCE 1 | 72.57 | 2.45 | 0.091 | 40 | 40 | 20 | 10 |
| (J) | 71.60 | 1.68 | 0.059 | 30 | 0 | <10 | 0 |
| (B) | 69.56 | 1.57 | 0.063 | 40 | 0 | 10 | 0 |
| −8 | 68.80 | 1.47 | 0.068 | 30 | 20 | 20 | 10 |
| −7 | 66.53 | 1.10 | 0.063 | 300 | 60 | 70 | 20 |
| (R) | 70.32 | 1.23 | 0.072 | 0 | 0 | 0 | 0 |
| (S) | 70.18 | 0.78 | 0.070 | 0 | 0 | 0 | 0 |
| (U) | 75.51 | 1.84 | 0.074 | 0 | 0 | 0 | 0 |
| (M) | 65.46 | 1.55 | 0.067 | 280 | 170 | 180 | 80 |
| (N) | 68.71 | 2.17 | 0.073 | 40 | 40 | 20 | 20 |
| (O) | 67.96 | 1.80 | 0.073 | 50 | 40 | 20 | 10 |
| Brittle | 66.64 | 2.70 | 0.072 | | | | |
| (QE) | 67.52 | 0.89 | 0.032 | 220 | 20 | 30 | <10 |
| (NQW) | 68.61 | 1.45 | 0.015 | 150 | 60 | 30 | <10 |
| (NQE) | 68.46 | 1.59 | 0.013 | 70 | 40 | 10 | 10 |
| (6H) | 68.74 | 1.77 | 0.113 | 40 | 30 | 20 | 10 |
| (1S) | 69.45 | 1.80 | 0.095 | 50 | 30 | 20 | <10 |
| (P2) | 67.09 | 1.9 | 0.091 | 70 | 60 | 40 | 30 |
| (1P) | 66.34 | 1.62 | 0.076 | 160 | 80 | 110 | 40 |
| (2P) | 67.13 | 1.61 | 0.077 | 140 | 60 | 60 | 20 |

TABLE 2-continued

| Corrosion Properties | | | | | | | |
|---|---|---|---|---|---|---|---|
| ID | Cu | Si | P | Max. Depth Long. | Max. Depth Trans. | Avg. Depth Long. | Avg. Depth Trans. |
| (3B) | 68.26 | 1.87 | 0.090 | 40 | 30 | 20 | 10 |
| (4B) | 68.53 | 1.87 | 0.090 | 20 | 30 | 10 | 10 |
| (5B) | 69.59 | 2.08 | 0.117 | 30 | 20 | 20 | 10 |
| (6B) | 69.53 | 2.1 | 0.117 | 30 | 20 | 10 | 10 |
| (NP) | 70.33 | 1.69 | 0.012 | 70 | 20 | 20 | <10 |
| (M1S) | 69.66 | 1.61 | 0.012 | 50 | 0 | 10 | 0 |
| (M2S) | 69.85 | 1.6 | 0.022 | 0 | 0 | 0 | 0 |
| (M3S) | 71.55 | 1.57 | 0.016 | 0 | 0 | 0 | 0 |
| (M4S) | 69.74 | 1.63 | 0.014 | 60 | 20 | <10 | <10 |
| (M5S) | 68.69 | 1.64 | 0.013 | 800 | 530 | 600 | 470 |
| (M6S) | 69.97 | 1.54 | 0.013 | 0 | 0 | 0 | 0 |
| R0 | 67.73 | 1.70 | 0.100 | 50 | 40 | 30 | 20 |
| R1 | 68.06 | 1.68 | 0.070 | 50 | 40 | 30 | 20 |

Notes
M1S - Al 0.014%, As 0.120%
M4S - As 0.115%, Co 0.099%, Mn 0.089%
M5S - Al 0.825%,
M6S - As 0.005%, Bi 0.133%, Mn 0.031%, Sb 0.093%, Se 0.004%, Te 0.034%
R0 - Mg 0.0002%
R1 - Mn 0.035%, Mg 0.0035%, Zr 0.005%

TABLE 2A

| Corrosion Properties | | | | | | | |
|---|---|---|---|---|---|---|---|
| ID | Cu | Si | P | Max. Depth Long. | Max. Depth Trans. | Avg. Depth Long. | Avg. Depth Trans. |
| A | 66.02 | 1.86 | 0.100 | 170 | 180 | 120 | 120 |
| B2 | 65.67 | 1.83 | 0.110 | 300 | 280 | 180 | 190 |
| C | 65.31 | 1.86 | 0.100 | 400 | 310 | 240 | 260 |
| J1 | 67.60 | 1.81 | 0.019 | 130 | 150 | 90 | 60 |
| J2 | 68.30 | 1.76 | 0.027 | 140 | 110 | 60 | 40 |
| J3 | 68.50 | 1.80 | 0.028 | 40 | 30 | 10 | 10 |
| J4 | 68.80 | 1.88 | 0.027 | 50 | 50 | 20 | 20 |

Notes
A - Mg 0.0003%, Cr 0.055%
B2 - Mg 0.0002%
C - Mg 0.0003%, Mn 0.243%
J1 - Base Composition
J2 - Li 0.11%
J3 - Misch 0.109%
J4 - B 0.0155%

Previous testing and literature have indicated that Alloy C27450 routinely fails the corrosion requirement of NSF 14-2012 due to de-zincification. In contrast, alloys C69300 and C26000 routinely pass the NSF 14-2012 requirements. Samples −7 and M, failed the NSF 14-2012 corrosion resistance requirement. Maximum penetration depths of 300 μm and 280 μm were obtained on samples −7 and M, respectively, in excess of the 200 μm maximum. In these samples, penetration was greatest along the pathways of the non-alpha phases present which were in the form of longitudinal stringers, aligned with the extrusion direction. A photograph illustrating this for sample M is shown in FIG. 2. The microstructures of samples −7 and M consisted of multiple phases. These two samples had the highest zinc content at 32.1% and 32.7% for −7 and M, respectively. Copper and silicon values for these samples were (66.53% Cu and 1.10% Si) and (65.46% Cu and 1.55% Si), respectively.

Samples 1P and NQW and others passed the NSF 14-2012 ISO 6509 requirement. Maximum penetration depths of 160 μm and 150 μm were obtained on samples 1P and NQW, respectively. The compositions of these samples were: 66.34 weight percent Cu, 1.62 weight percent Si, and 31.85 weight percent Zn; and 68.61 weight percent Cu, 1.45 weight percent Si, and 29.82 weight percent Zn, respectively. The chemical differences, both within the base alloys and within the phases present are believed responsible for the performance difference between alloys −7 and M (which failed) and alloys 1P and NQW (which passed). From this data, a corrosion pass-fail boundary can be determined.

The compositional boundary lines of: 66% minimum copper coupled with 1.3% minimum silicon content appears to represent a boundary to reliably pass NSF 14-2012 ISO 6509 corrosion testing.

All other samples tested within the targeted compositional box passed the NSF 14-2012 requirements of the ISO 6509 test with most having penetration depths 100 μm. Each of these other samples had lower zinc contents, with the highest being at 31.85 weight percent.

Figure 3:
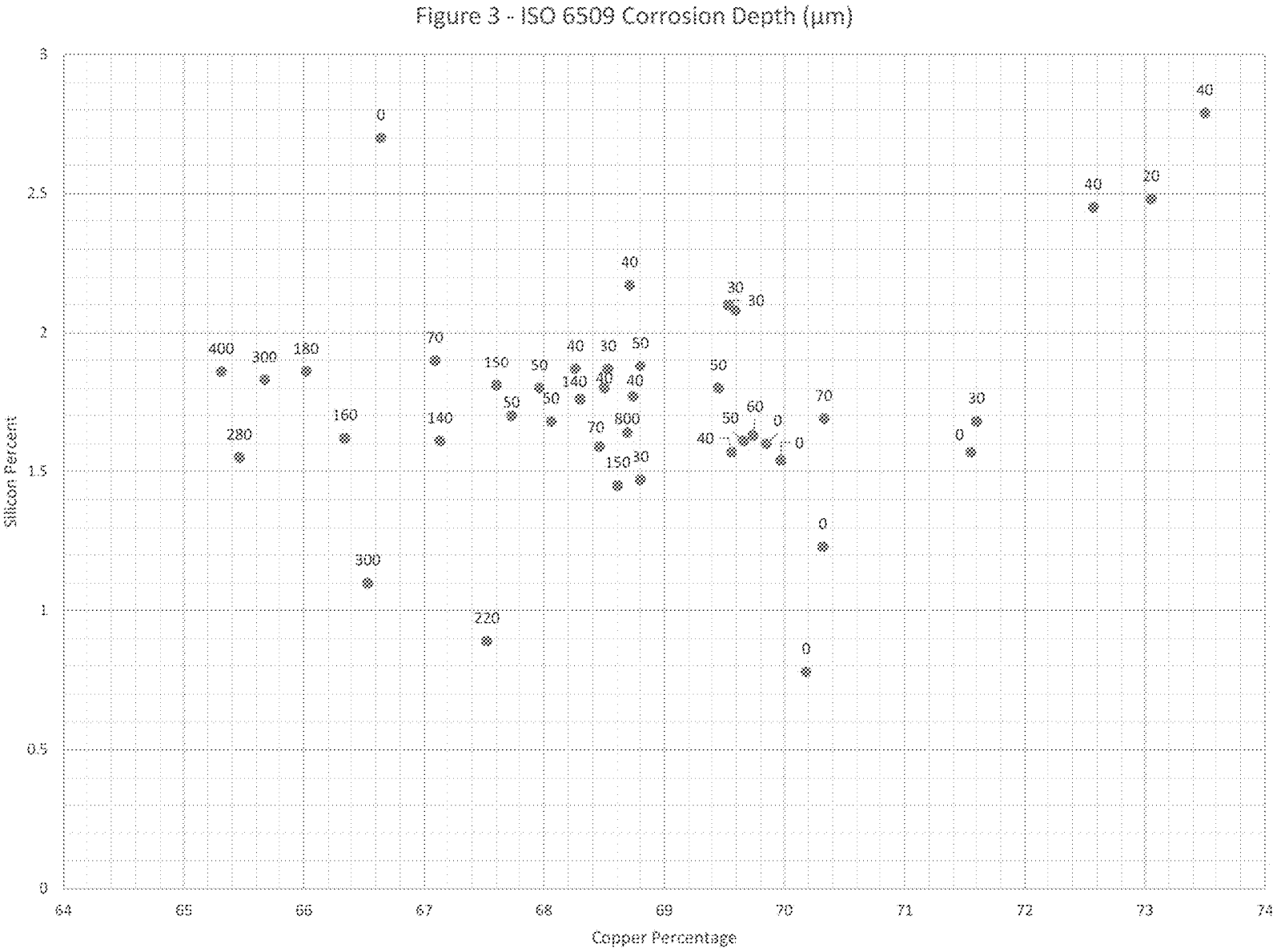
FIG. 3 is a copper vs. silicon diagram similar to FIG. 1, showing corrosion measurements, made in accordance with ISO 6509.

ISO 6509 corrosion data for the maximum depth of penetration in the longitudinal direction is summarized in FIG. 3. In summary, the samples passing corrosion criteria had either: a) a single phase microstructure, or b) multiphase microstructures with copper contents greater than 66% and silicon contents above 1.3%.

Corrosion data in Table 2 indicates that alloys with copper content below 70 weight percent can pass NSF 14-2012 requirements of the ISO 6509 tests. The preferred compositional range including silicon in the alloy passes the NSF 14-2012 ISO 6509 testing requirements, whereas compositions near but outside this range do not.

Mechanical Properties

The tensile strength, yield strength, elongation to fracture, and Rockwell B hardness for various compositions were measured and the results are presented in Table 3.

TABLE 3

| Samples and Mechanical Properties | | | | | | | | | | |
|---|---|---|---|---|---|---|---|---|---|---|
| | | | | Strength, ksi | | Elongation | Hardness Rockwell | ¾ | ½ | |
| ID | Cu | Si | P | Tensile | Yield | % | B Surface | radius | radius | Center |
| (K) | 73.50 | 2.79 | 0.084 | 77.24 | 40.28 | 20.8 | 81 | 85 | 84 | 84 |
| LCE2 | 73.05 | 2.48 | 0.093 | 76.6 | 34.8 | 39.4 | 69 | 72 | 72 | 71 |
| LCE1 | 72.57 | 2.45 | 0.091 | 76.7 | 34.7 | 42.7 | 69 | 71 | 71 | 70 |
| (J) | 71.60 | 1.68 | 0.059 | 66.18 | 36.21 | 56.0 | 74 | 75 | 70 | 64 |
| (B) | 69.56 | 1.57 | 0.063 | 73.43 | 46.24 | 35.2 | 80 | 83 | 78 | 76 |
| −8 | 68.80 | 1.47 | 0.068 | 73.04 | 50.42 | 31.9 | 74 | 80 | 77 | 75 |
| −7 | 66.53 | 1.10 | 0.063 | 73.21 | 49.68 | 35.9 | 74 | 79 | 76 | 74 |
| (R) | 70.32 | 1.23 | 0.072 | 68.94 | 40.57 | 50.7 | 76 | 78 | 73 | 70 |
| (S) | 70.18 | 0.78 | 0.07 | 63.04 | 40.54 | 47.9 | 66 | 70 | 66 | 64 |

TABLE 3-continued

| Samples and Mechanical Properties | | | | | | | | | | |
|---|---|---|---|---|---|---|---|---|---|---|
| | | | | Strength, ksi | | Elonga-tion | Hardness Rockwell | ¾ | ½ | |
| ID | Cu | Si | P | Tensile | Yield | % | B Surface | radius | radius | Center |
| (U) | 75.51 | 1.84 | 0.074 | 66.28 | 38.79 | 59.0 | 72 | 76 | 70 | 62 |
| (M) | 65.46 | 1.55 | 0.067 | 81.85 | 55.04 | 12.5 | 86 | 89 | 86 | 84 |
| (N) | 68.71 | 2.17 | 0.073 | 78.76 | 53.8 | 7.1 | 86 | 90 | 86 | 83 |
| (O) | 67.96 | 1.80 | 0.073 | 78.12 | 53.14 | 19.6 | 82 | 87 | 84 | 82 |
| Brittle | 66.64 | 2.70 | 0.072 | | | | | | | |
| (QE) | 67.52 | 0.89 | 0.032 | 67.8 | 47.36 | 40.3 | 72 | 76 | 72 | 66 |
| (NQW) | 68.61 | 1.45 | 0.015 | 73.47 | 50.94 | 35.7 | 79 | 83 | 79 | 77 |
| (NQE) | 68.46 | 1.59 | 0.013 | 73.14 | 50.68 | 34.9 | 78 | 82 | 78 | 67 |
| (6H) | 68.74 | 1.77 | 0.113 | 73.64 | 51.05 | 27.7 | 78 | 82 | 79 | 70 |
| (1S) | 69.45 | 1.80 | 0.095 | | | | 81 | 84 | 82 | 77 |
| (P2) | 67.09 | 1.90 | 0.091 | 79.39 | 55.57 | 10.2 | 85 | 91 | 87 | 85 |
| (1P) | 66.34 | 1.62 | 0.076 | 77.33 | 53.06 | 19.1 | 73 | 87 | 84 | 81 |
| (2P) | 67.13 | 1.61 | 0.077 | 73.3 | 52.41 | 22.4 | 67 | 87 | 80 | 81 |
| (3B) | 68.26 | 1.87 | 0.090 | 74.61 | 53.5 | 19.4 | 71 | 85 | 85 | 76 |
| (4B) | 68.53 | 1.87 | 0.090 | 72.17 | 50.95 | 31.0 | 65 | 82 | 79 | 82 |
| (5B) | 69.59 | 2.08 | 0.117 | 73.99 | 51.27 | 29.7 | 68 | 84 | 80 | 77 |
| (6B) | 69.53 | 2.10 | 0.117 | 76.7 | 53.66 | 20.1 | 74 | 86 | 86 | 78 |
| (NP) | 70.33 | 1.69 | 0.012 | 71.85 | 49.08 | 35.7 | 75 | 78 | 75 | 64 |
| (M1S) | 69.66 | 1.61 | 0.012 | 74.55 | 48.98 | 36.1 | 75 | 82 | 80 | 75 |
| (M2S) | 69.85 | 1.60 | 0.022 | 76.75 | 49.71 | 36.4 | 77 | 83 | 80 | 73 |
| (M3S) | 71.55 | 1.57 | 0.016 | 67.78 | 41.07 | 32.8 | 72 | 78 | 71 | 56 |
| (M4S) | 69.74 | 1.63 | 0.014 | 73.74 | 47.11 | 35.5 | 78 | 82 | 79 | 57 |
| (M5S) | 68.69 | 1.64 | 0.013 | 82.41 | 55.44 | 14.9 | 84 | 88 | 86 | 83 |
| (M6S) | 69.97 | 1.54 | 0.013 | 67.01 | 41.73 | 38.6 | 74 | 75 | 69 | 54 |
| R0 | 67.73 | 1.70 | 0.10 | 76.93 | 52.88 | 26.1 | 79 | 86 | 81 | 79 |
| R1 | 68.06 | 1.68 | 0.07 | 76.63 | 53.71 | 26.0 | 78 | 83 | 82 | 80 |

Notes
M1S - Al 0.014%, As 0.120%
M4S - As 0.115%, Co 0.099%, Mn 0.089%
M5S - Al 0.825%,
M6S - As 0.005%, Bi 0.133%, Mn 0.031%, Sb 0.093%, Se 0.004%, Te 0.034%
R0 - Mg 0.0002%
R1 - Mn 0.035%, Mg 0.0035%, Zr 0.005%

TABLE 3A

| Samples and Mechanical Properties | | | | | | | |
|---|---|---|---|---|---|---|---|
| | | | | Strength, ksi | | Elongation | Hardness, Rockwell B |
| ID | Cu | Si | P | Tensile | Yield | % | Surface |
| A | 66.02 | 1.86 | 0.10 | 74.14 | 34.52 | 12.9 | 89 |
| B2 | 65.67 | 1.83 | 0.11 | 78.84 | 39.52 | 17.5 | 93 |
| C | 65.31 | 1.86 | 0.10 | 80.58 | 39.06 | 11.2 | 91 |
| J1 | 67.60 | 1.81 | 0.019 | 88.4 | 57.7 | * | 87 |
| J2 | 68.30 | 1.76 | 0.027 | 79.1 | 48.8 | * | 92 |
| J3 | 68.50 | 1.80 | 0.028 | 75.3 | 47.3 | * | 90 |
| J4 | 68.80 | 1.88 | 0.027 | 76.0 | 45.9 | * | 90 |

Notes
A - Mg 0.0003%, Cr 0.055% (hot rolled plate)
B2 - Mg 0.0002%, (hot rolled plate)
C - Mg 0.0003%, Mn 0.243% (hot rolled plate)
*Comparison elongation data not available for J series samples as the sample geometry and surface condition differed.
J1 - Base Co (thin hot rolled plate)
J2 - Li 0.11% (thin hot rolled plate)
J3 - Misch 0.109% (thin hot rolled plate)
J4 - B 0.0155% (thin hot rolled plate)

The percentage elongation to fracture obtained via tensile testing varied significantly among samples. Sample U broke after 59% elongation, (a high value indicating very ductile material that stretches well but is difficult to fracture). It, along with similar samples, (S) having very high elongation values had a microstructure composed of either all alpha phase, or only having minimal trace percentages of other phases.

In contrast, sample O, a sample with similar silicon percentage as sample U, broke after 19.6% elongation, (a lower value or less ductility). Sample 0, although it has a similar silicon percentage to sample U, has less copper and more zinc.

Metallographically, the microstructure of this sample (with 5.5% less copper than U) had a significantly large volume fraction of non-alpha phase(s). The sample composition indicated as "Brittle" broke during the cooling of the cast log and was not processed into finished rod. Generally alloys with Cu<70 weight percent and Si>2 weight percent, and more specifically alloys with Si>0.167*Cu-9.28, will be brittle or have inadequate ductility for some applications and are thus generally less desirable.

Figure 4:
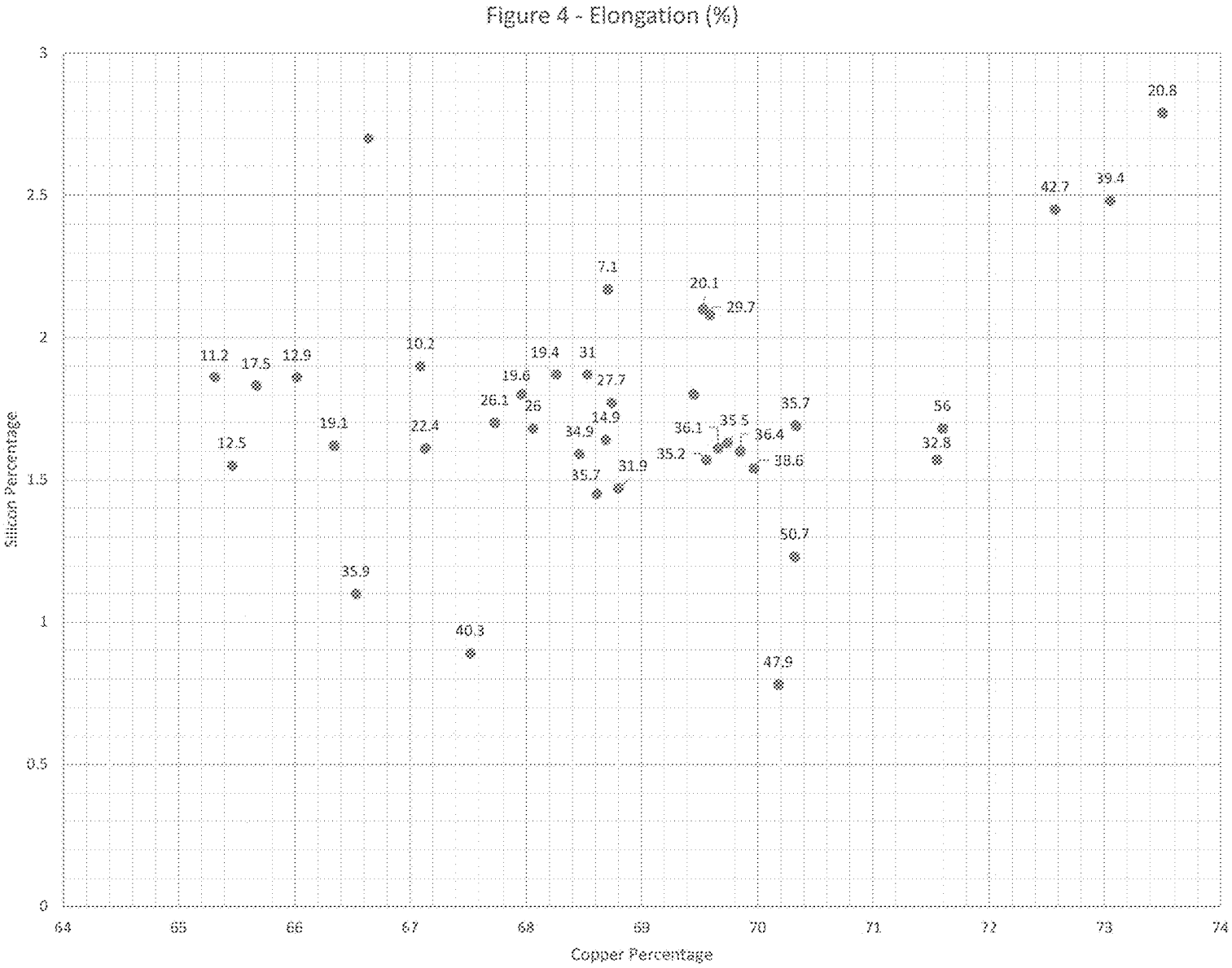
FIG. 4 is a copper vs. silicon diagram similar to FIG. 1, showing elongation measurements (percentages)

The ductility of the compositions varied, generally with increasing ductility if copper is increased and silicon decreased, and correspondingly decreasing ductility if copper is decreased and silicon increased. This is indicated in FIG. 4. These ductility trends appeared to match metallographic versus composition trends in unison with the percentage of non-alpha phases visible in the microstructure.

Microstructure

The microstructures presented in the Figures represent a "wrought" condition obtained by subsequent working and heating of a cast product. It is believed that the microstructure and properties of wrought material differ from those of an "as-cast" product with the same composition.

Representative selected micrographs of longitudinal sections at 1,000× are shown in FIGS. 5-10. Samples for property testing of: corrosion, mechanical, machining, and microstructure are from wrought mill finished rod that was: cast, hot worked, and then cold drawn to finish dimensions. The area reduction from working was preferably at least 4:1 and more preferably at least 5:1. Samples produced from laboratory castings that were processed as hot rolled plate are: A, B2, C, J1, J2, J3, and J4. This processing also produced a wrought microstructure.

Twinned alpha (a) grains are the primary phase in all samples evaluated. The volume fraction of this phase varied from 60-100%, and varied with composition. Alpha phase is a face-centered-cubic (fcc) microstructure that is very ductile. In samples with higher percentages of zinc and/or silicon, longitudinal stringers of non-alpha phase(s) are also present. These phases generally have less cold ductility when compared to alpha phase.

Figure 5:
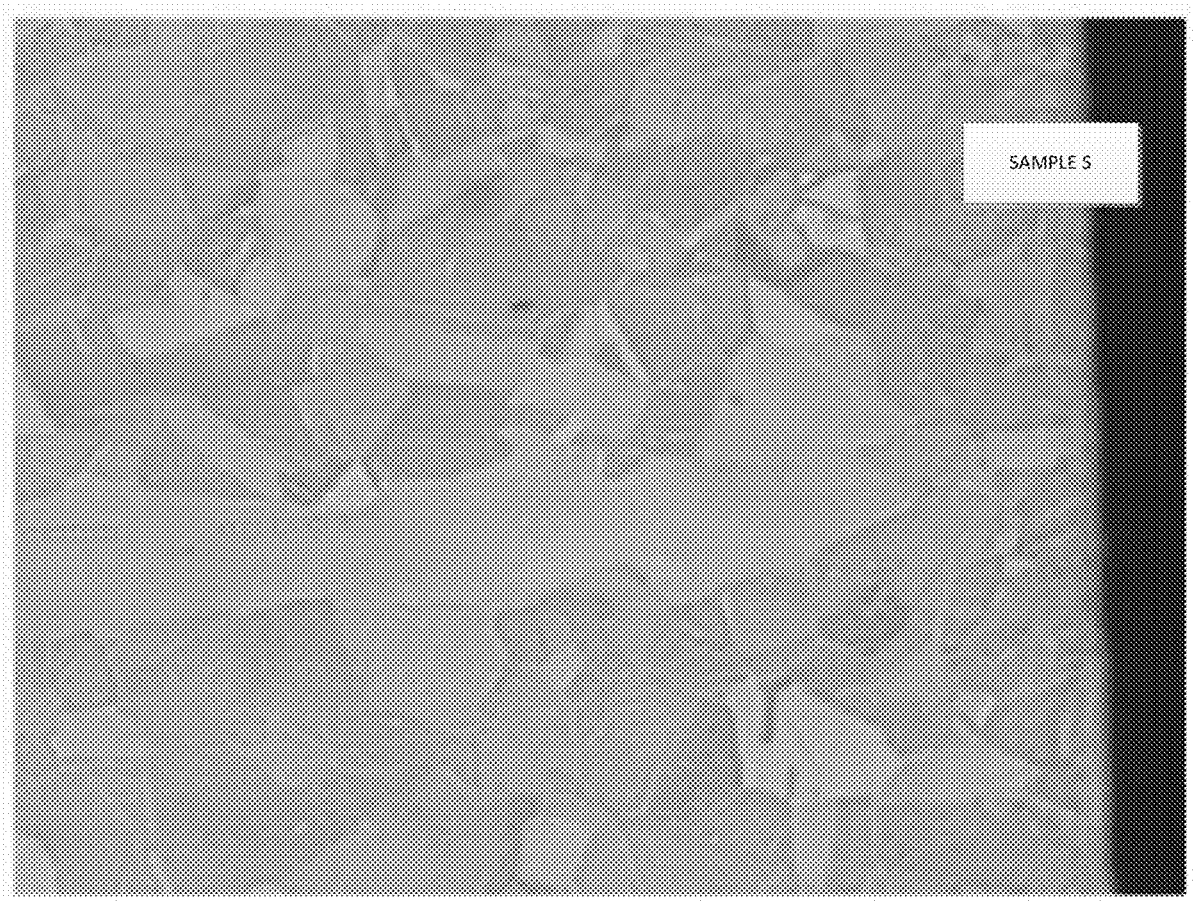
FIG. 5 is a photomicrograph at 1000× of Sample S, showing nearly 100% alpha phase.
Figure 6:
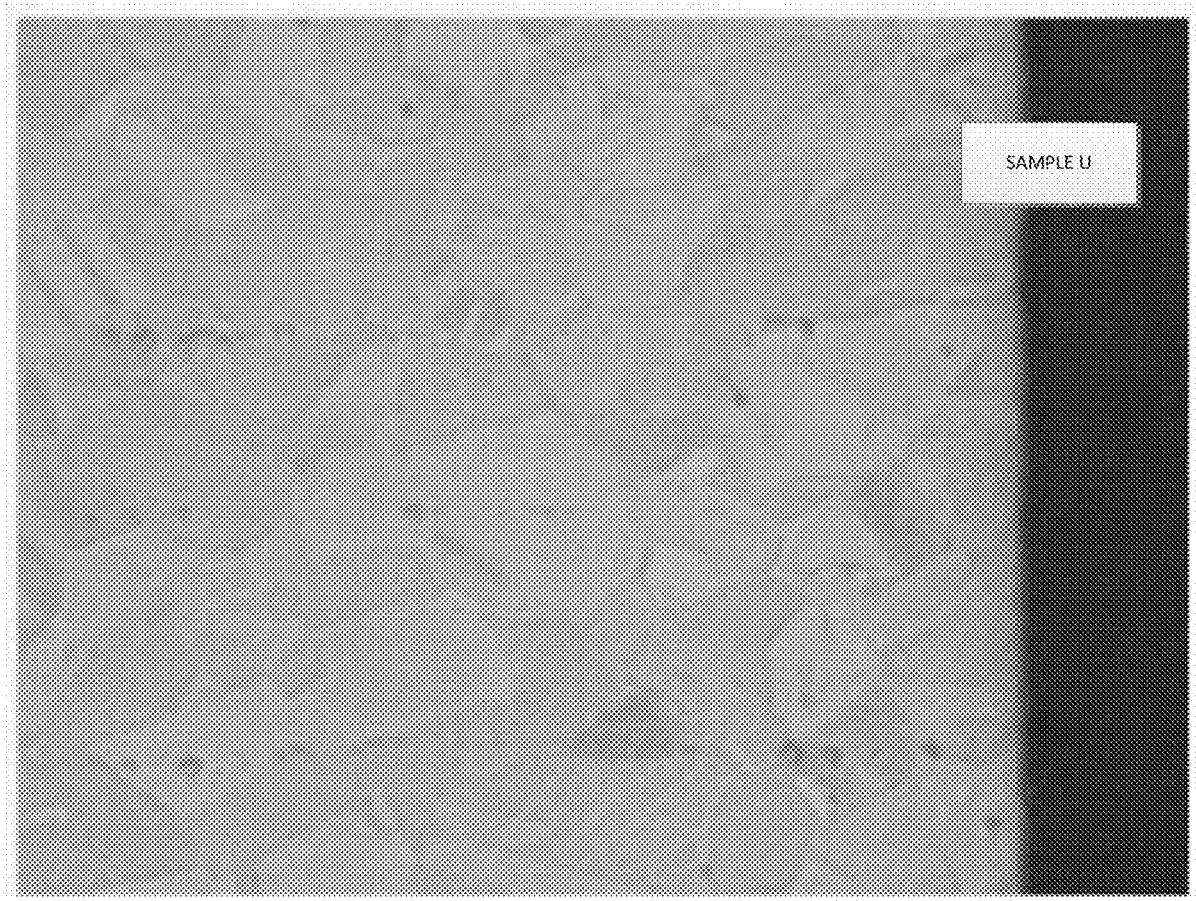
FIG. 6 is a photomicrograph at 1000× of Sample U, showing nearly 100% alpha phase.

FIGS. 5-6 show compositions with a structure having a low volume fraction of non-alpha phases present. Casting dendrites and the associated micro-segregation and chemical coring are not readily apparent. It is believed this is a result of the processing after casting that was performed. Alloys of this type machined with difficulties as long ribbon chips were encountered. The ribbons, when difficult to fracture, formed tangled "hair balls" which did not discharge from the machine uniformly. This generated chip interference issues leading to observed chatter on parts and other machine operation difficulties. These compositions, represented samples by S and U, are identified as Group L.

Figure 7:
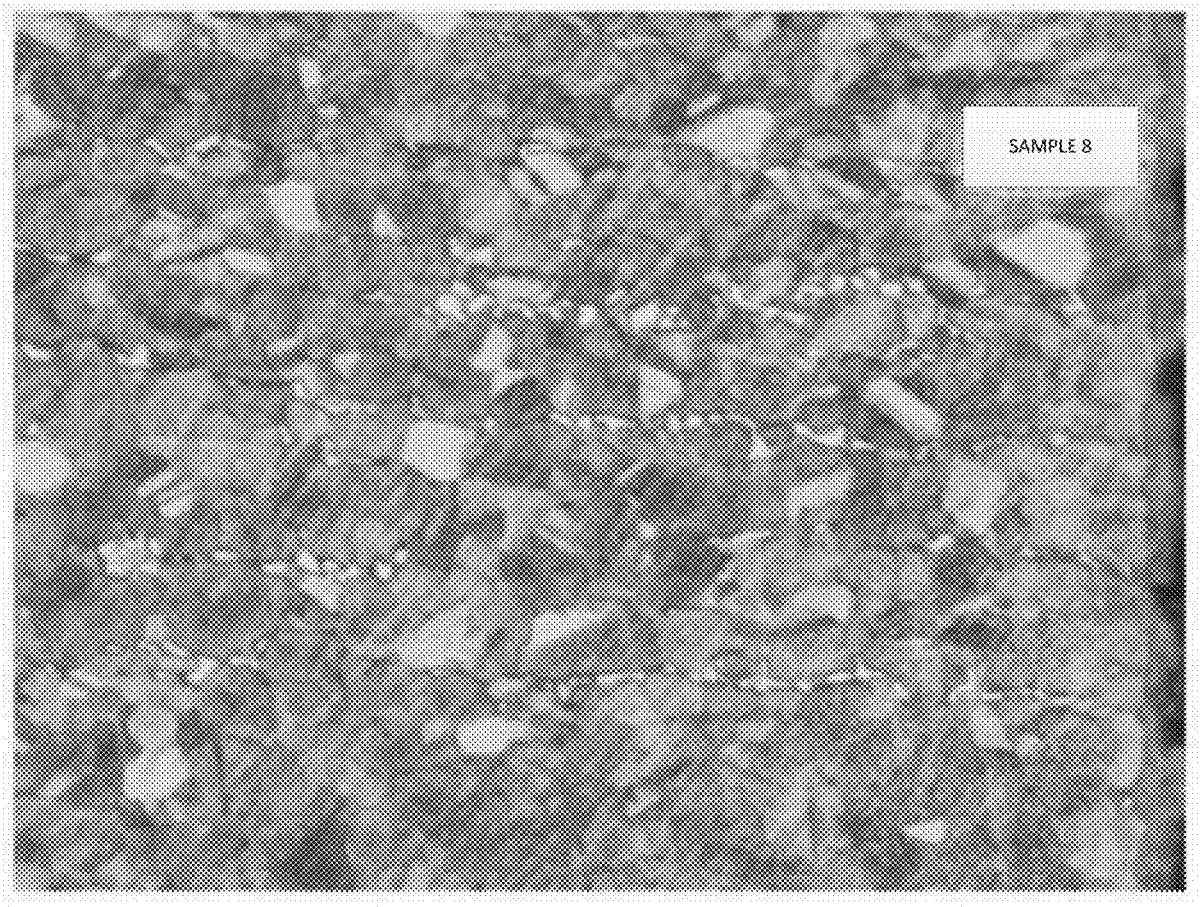
FIG. 7 is a photomicrograph at 1000× of Sample −8, showing an significant volume of non-alpha phases.
Figure 8:
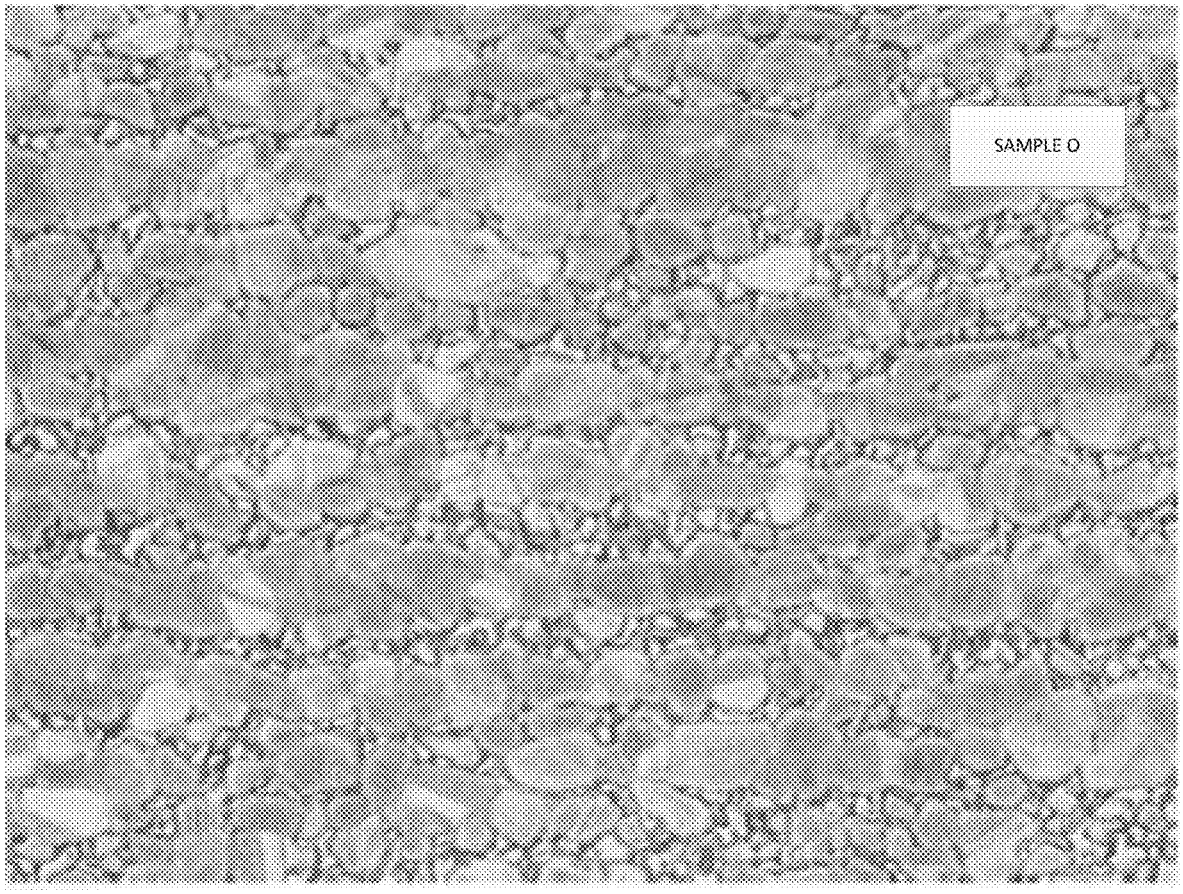
FIG. 8 is a photomicrograph at 1000× of Sample O, showing a significant volume of non-alpha phases.
Figure 9:
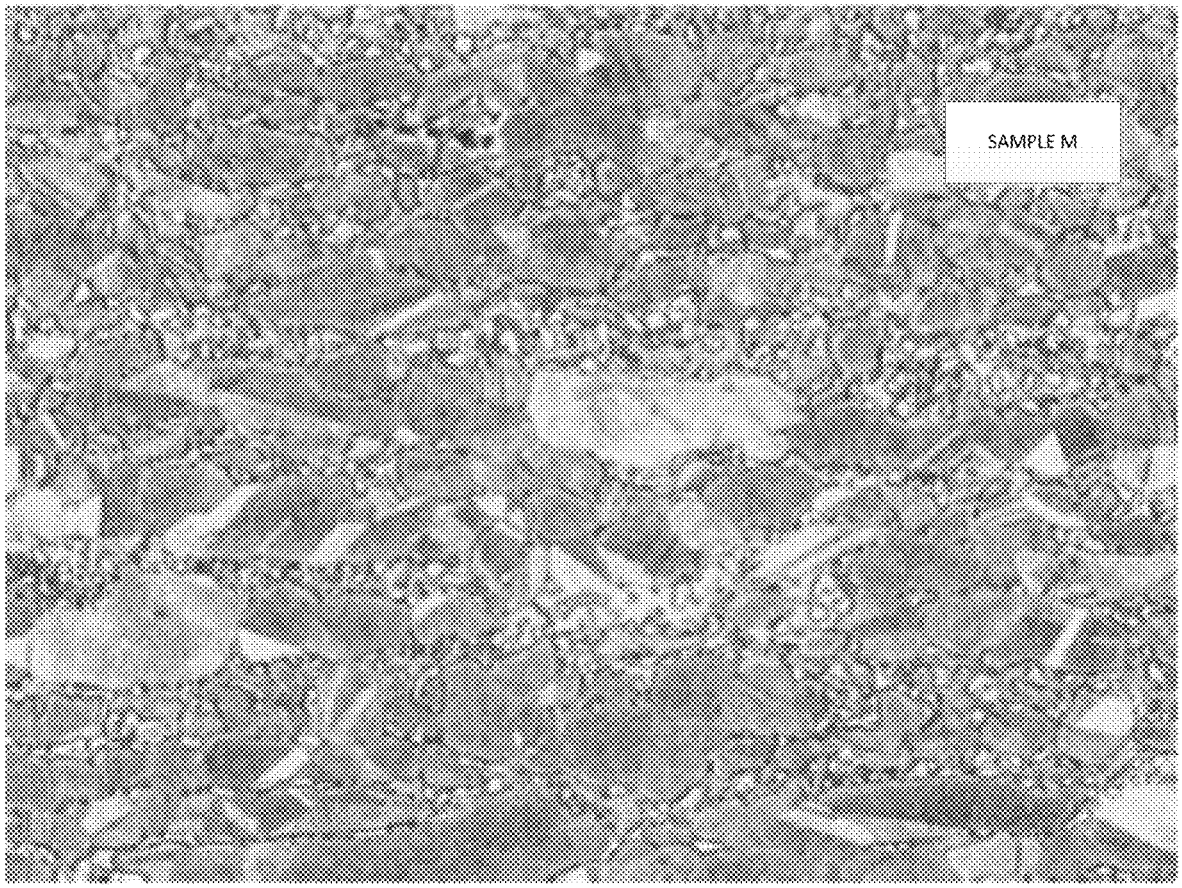
FIG. 9 is a photomicrograph at 1000× of Sample M, showing a significant volume of non-alpha phases.

FIGS. 7, 8, and 9 show compositions with a structure having a significant volume fraction of non-alpha phases present. This microstructure was observed with alloys with Si>1.3 weight percent. These alloys machined well with short chips. These compositions, represented by samples −8, M, and O, are identified as Group S.

Figure 10:
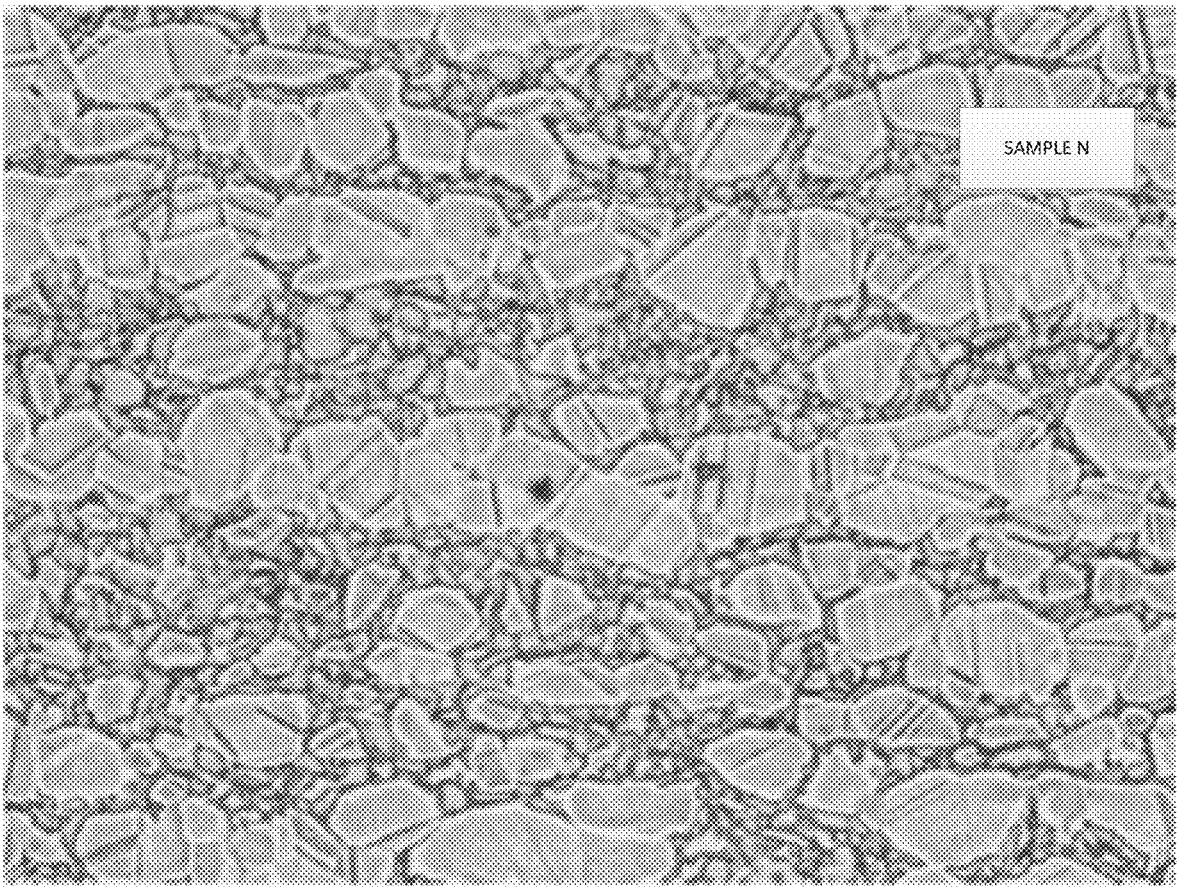
FIG. 10 is a photomicrograph at 1000× of Sample N, showing a greater volume of non-alpha phases when compared to Samples −8, O, and M.

Sample N at 2.17 weight percent silicon was the lowest elongation material finished into parts. Although this composition machined well with small chips, the parts were fragile and split in a "brittle" manner after being deformed. Additionally, some mill processing issues were encountered during the processing of this lower elongation material. Due to these issues, the preferred alloy contains less than 2.0 weight percent silicon consistent with obtaining a desired set of properties. The microstructure of sample N is shown in FIG. 10.

Chip Size

Figure 11:
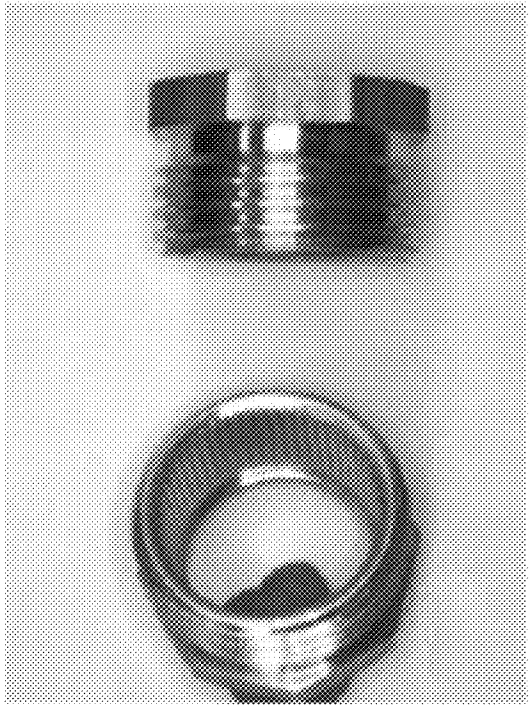
FIG. 11 is a photograph of a fitting machined from the samples.
Figure 12:
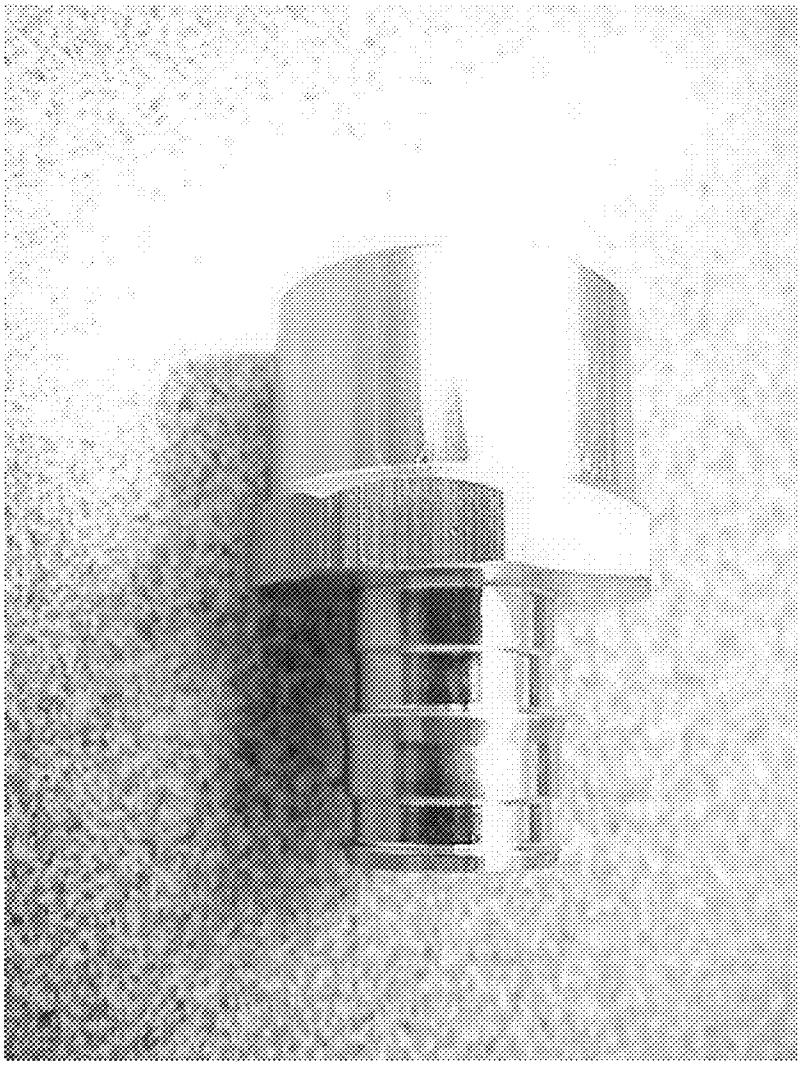
FIG. 12 is a photograph of an additional fitting machined from Sample S.

FIGS. 13, 18-20, and 22-28 show the machining swarf (chips) obtained during the machining of various compositions of alloys into a fitting for a water hose shown in FIG. 11. In excess of 100 parts were successfully machined from each composition from octagonal cross-section shape with a dimension of 1.062" across (flat-to-flat), using a six spindle Acme screw machine. The machine used has a history of running this part out of leaded brass and lead-free brass alloys. Run speed was at a typical production part rate of 1 part per 2.5 seconds. Machining was monitored for: chip size and breakage characteristics, part smoothness of finish, part dimensions, temperature rise of cutting fluid, and machine torque load. Of these the most informative was the chip length and breakage characteristics as pronounced differences among compositions were detected.

Tooling geometries and machining speeds were not altered during these trials. Therefore, neither a determination of optimal machining conditions nor a precise "machinability rating" value for each of these compositions was made. Instead a boundary between poor and unacceptable versus acceptable was determined.

Samples of the machining swarf (chips) were taken at the discharge conveyor of the machine. The machining processes generated three major chip types, each at roughly 0.020" thick. These are (1) a slender ribbon approximately 0.020" thick×0.040"×length (Ribbon Chip); (2) a spiral chip from an inside diameter hole approximately 0.020"×0.350"×length (Drill Chip); and (3) an irregularly shaped chip with fingerlike projections off of a side band generated from an outside form tool. Dimensions were roughly 0.020" thick×0.020" with 0.350" long fingers×length (Form Chip). Of these the ribbon chip (#1) swarf is considered to most clearly indicate differences in machining performance.

Alloy Machining Behavior

Two groupings of chip behavior were noted during evaluation. There are compositions that produced long ribbon chips that were difficult to fracture. This group encountered machining difficulties or concerns. This machining group aligns with Group L, microstructure group with a low fraction of non-alpha phases, detailed previously. Compositions that machined without issue, aligned with Group S. For compositions that measured higher elongation on tensile testing, the discard chips were in general longer, especially the ribbon chip.

Figure 13:
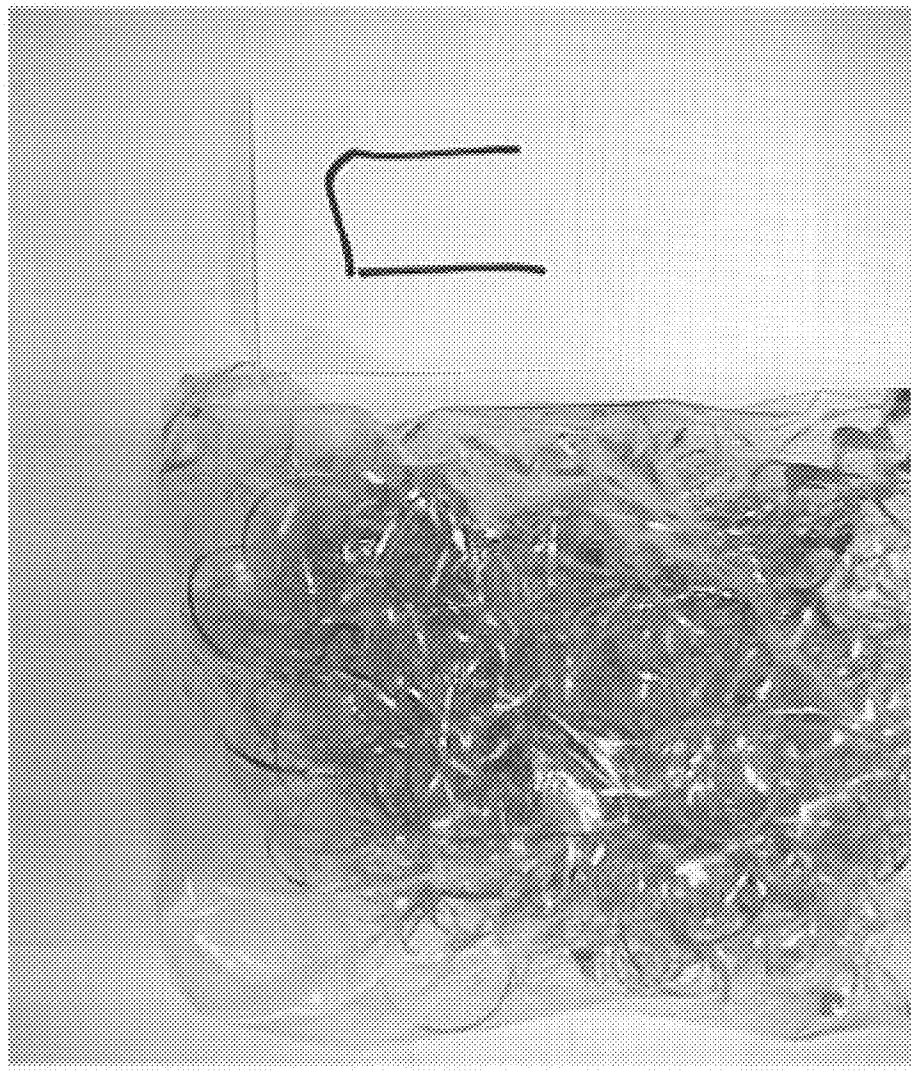
FIG. 13 is a photograph showing the long, unbroken ribbon chip from machining Sample U.
Figure 14:
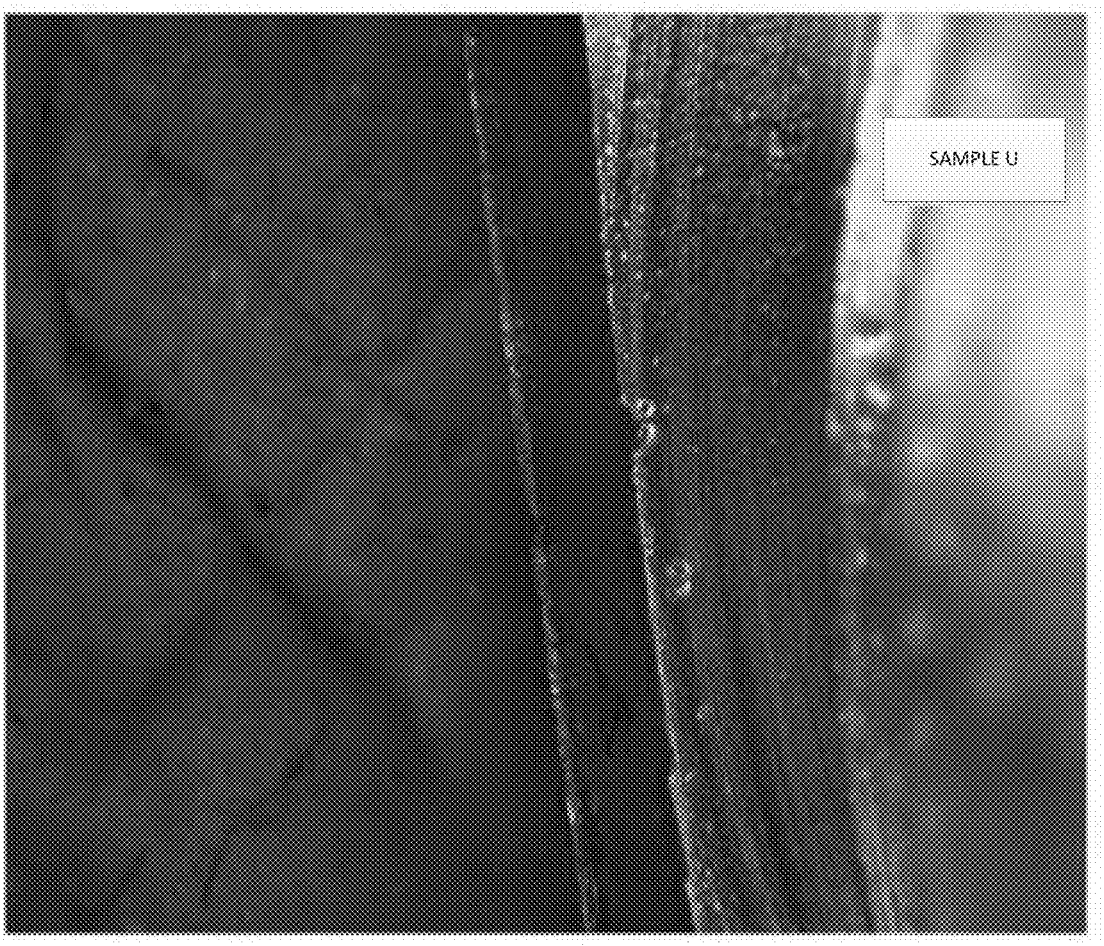
FIG. 14 is a photomicrograph at 40× of the part shown in FIG. 11 made from Sample U, showing an edge burr.
Figure 15:
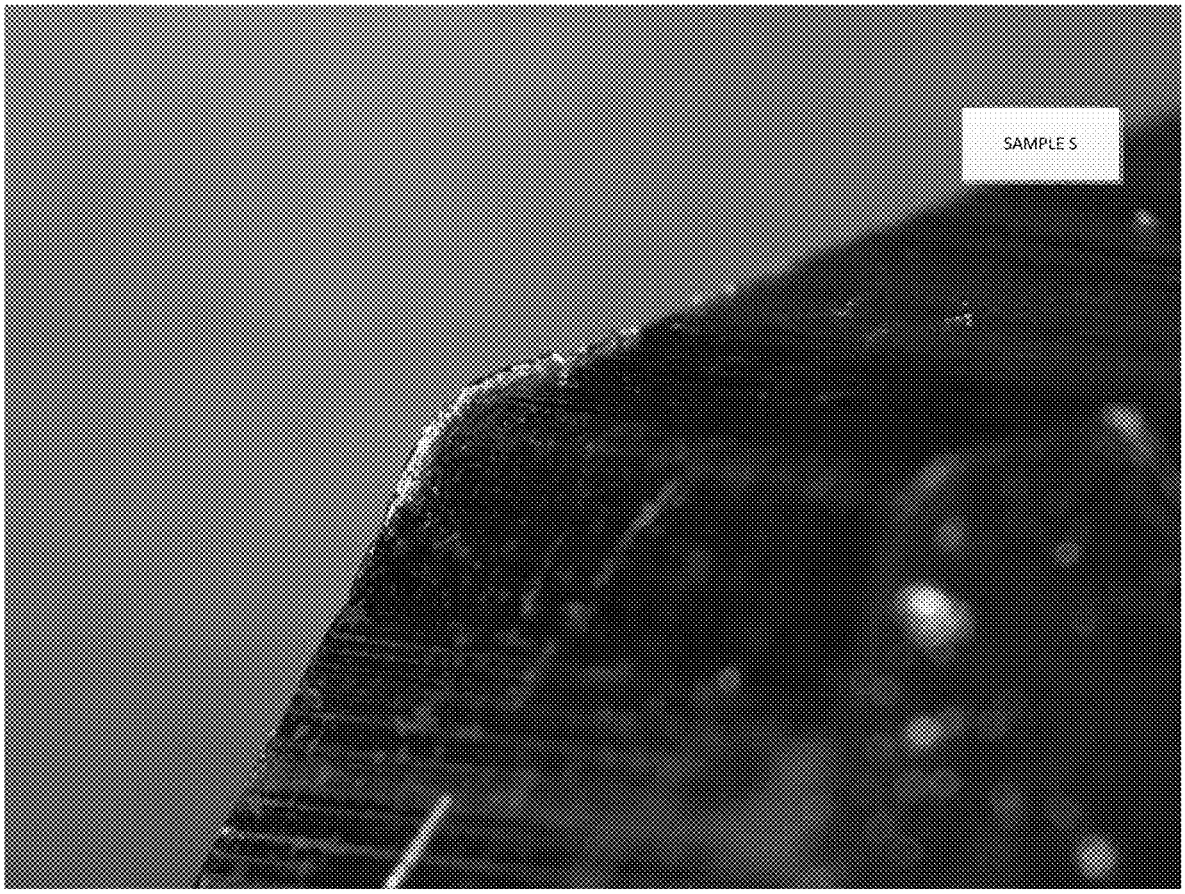
FIG. 15 is a photomicrograph at 50× of the part shown in FIG. 12 made from Sample S, showing an edge burr.
Figure 16:
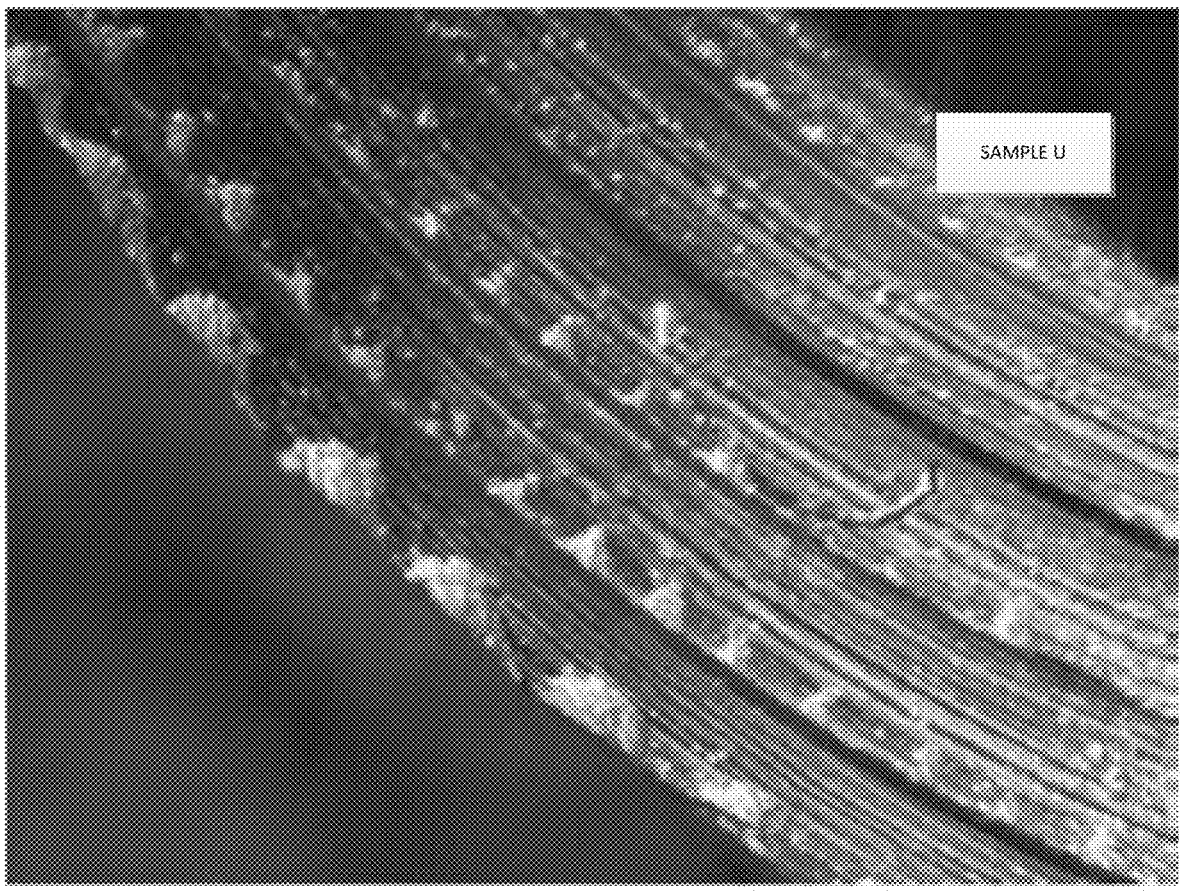
FIG. 16 is a photomicrograph at 40× of a part shown in FIG. 11 made from Sample U, showing the thread area with alternating shear areas and breakage areas.
Figure 17:
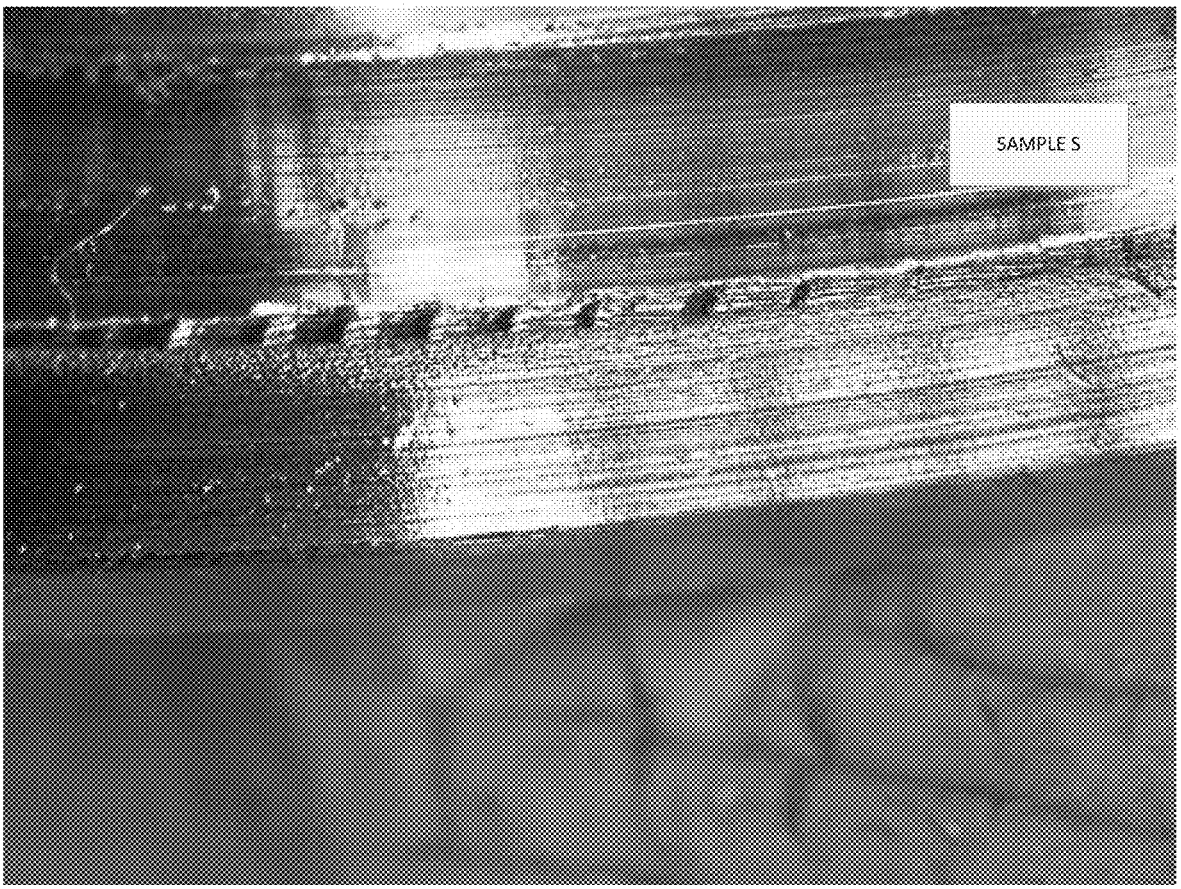
FIG. 17 is a photomicrograph at 50× of a part shown in FIG. 12 made from Sample S, showing the thread area with alternating shear areas and breakage areas.

The highest elongation sample U, had the slender ribbon chip form into tangled "hair balls" that were difficult to fracture by hand bending. These tangles did not always drop out of the bottom of the screw machine and discharge properly. These chips are shown in FIG. 13. Consequently, the machine had to be stopped and cleaned of scrap several times before machining was able to resume for additional parts. The ribbon chips formed remained relatively ductile and did not readily fracture upon being bent 90°. An unacceptable burr remained along the octagon edge on some parts from this grouping. This is shown in FIG. 14 (for Sample U) and FIG. 15 (for Sample S). Additionally, several parts had periodic chatter marks on the threaded area that may be related to interference issues with ribbon tangles. This is shown in FIG. 16 (for Sample U) and FIG. 17 (for Sample S). This undesirable irregular thread finish was not noted in Group S.

Figure 18:
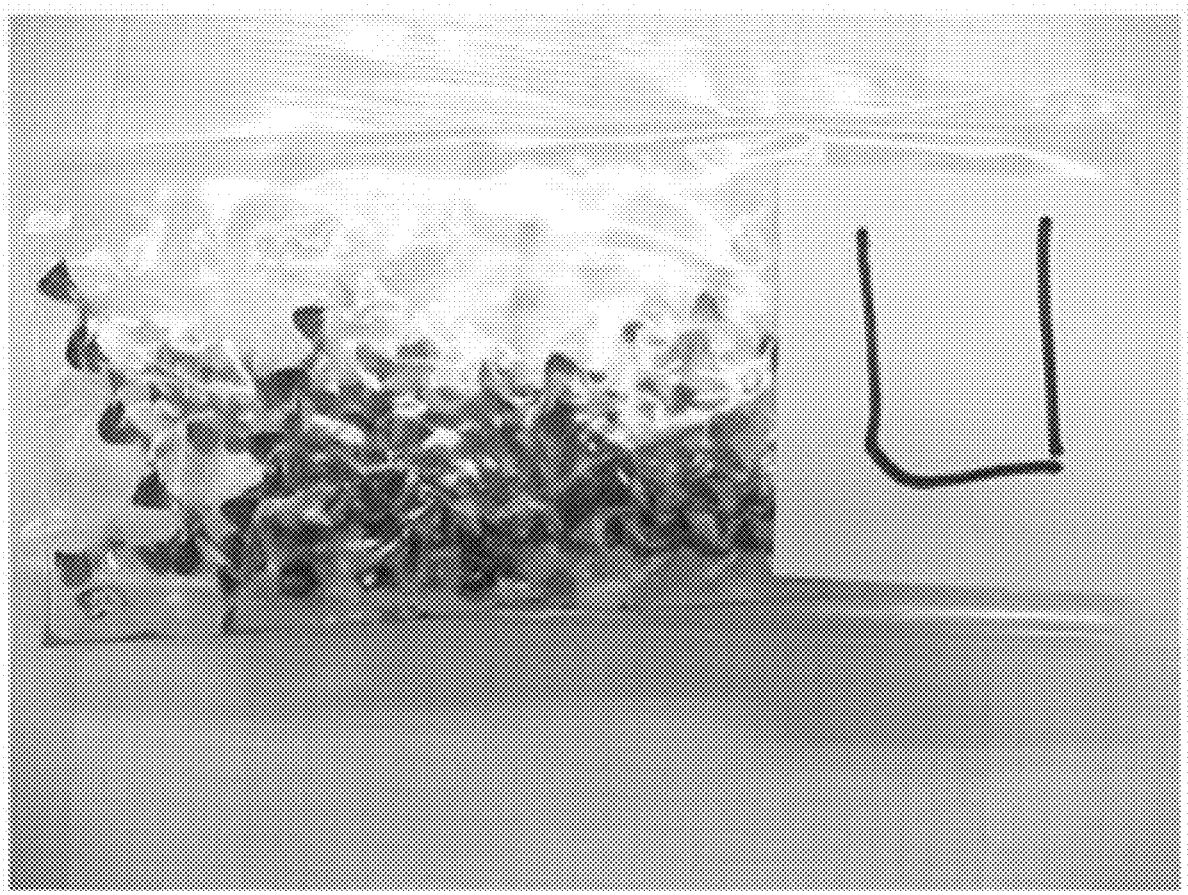
FIG. 18 is a photograph of a drill chip from Sample U.
Figure 19:
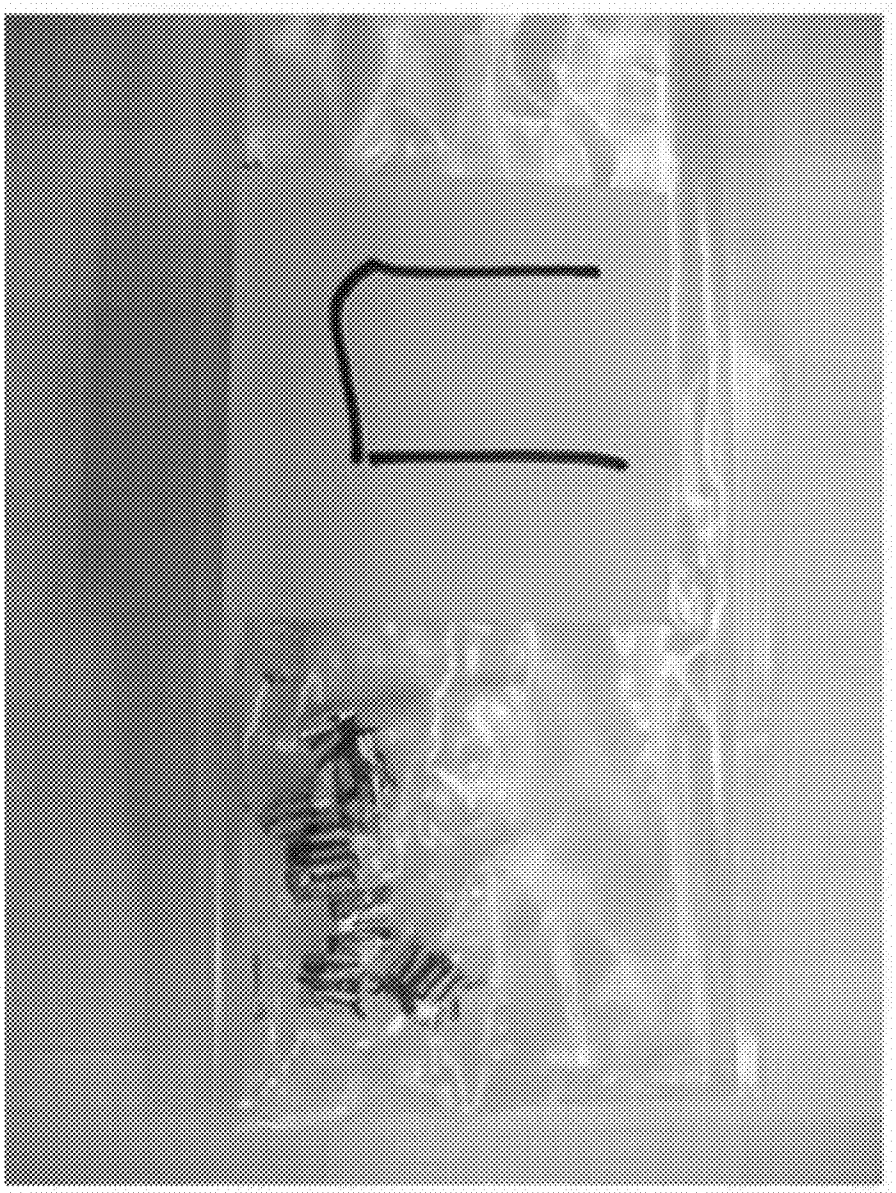
FIG. 19 is a photograph of form tool chips from Sample U.

During machining of Group L compositions, chip types referred to as the form and drill initially had some long chips exiting the machine. However, as multiple parts were produced, the chips were generally shorter. It is believed this is likely due to the additional bending the chips and scrap was forced to do because of the interference generated from the ribbon chips. Drill chips from sample U were generally long and unbroken and are shown in FIG. 18. Form tool chips from Sample U are shown in FIG. 19.

Figure 20:
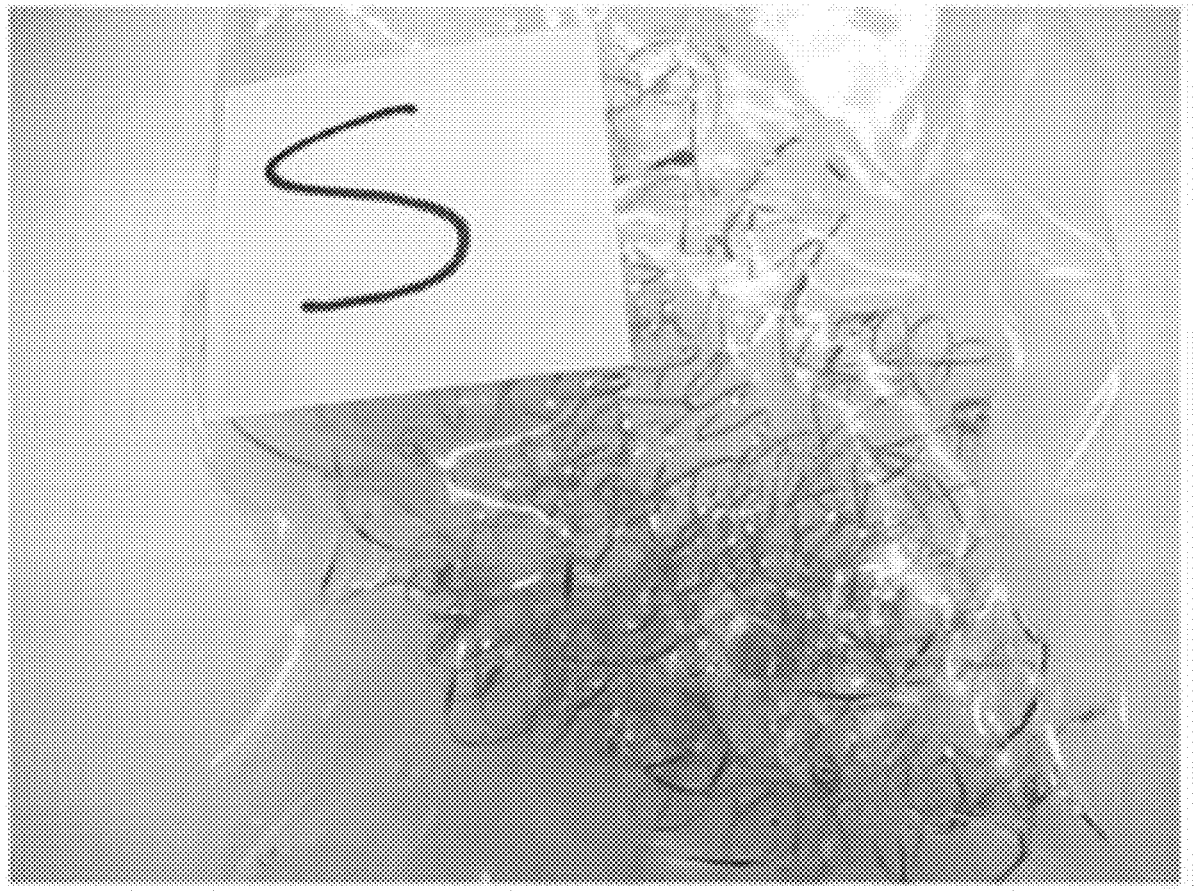
FIG. 20 is a photograph showing long unbroken ribbon chips from Sample S.

Sample S had similar chips to sample U but machining stoppages were not encountered during the limited number of parts produced. Ribbon chips from sample S are shown in FIG. 20.

Figure 21:
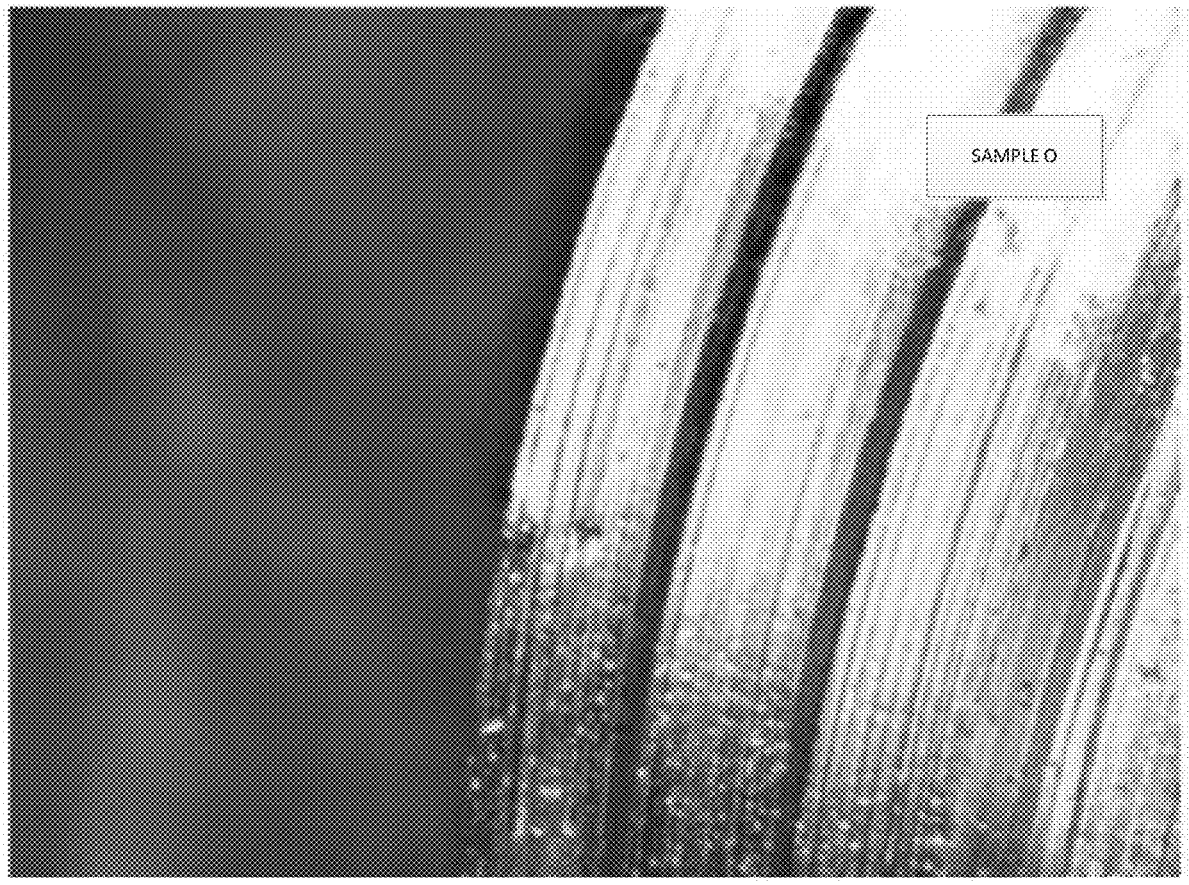
FIG. 21 is a photograph showing a part made from Sample O, showing smooth threads, with a sharp cut.

No machining difficulties were encountered on compositions from Group S and the part finish was deemed to be excellent. Threads were smooth and sharp. FIG. 21 is a photograph of threads from sample O. In contrast to Group L, Group S samples, with lower elongation values on the tensile test had all the chip types fracture into small pieces prior to exiting the machine. The microstructure of Group S had a significant volume of non-alpha phase(s) present. Chips that were collected and photographed are an assortment of fragments of all three chip forms.

Figure 22:
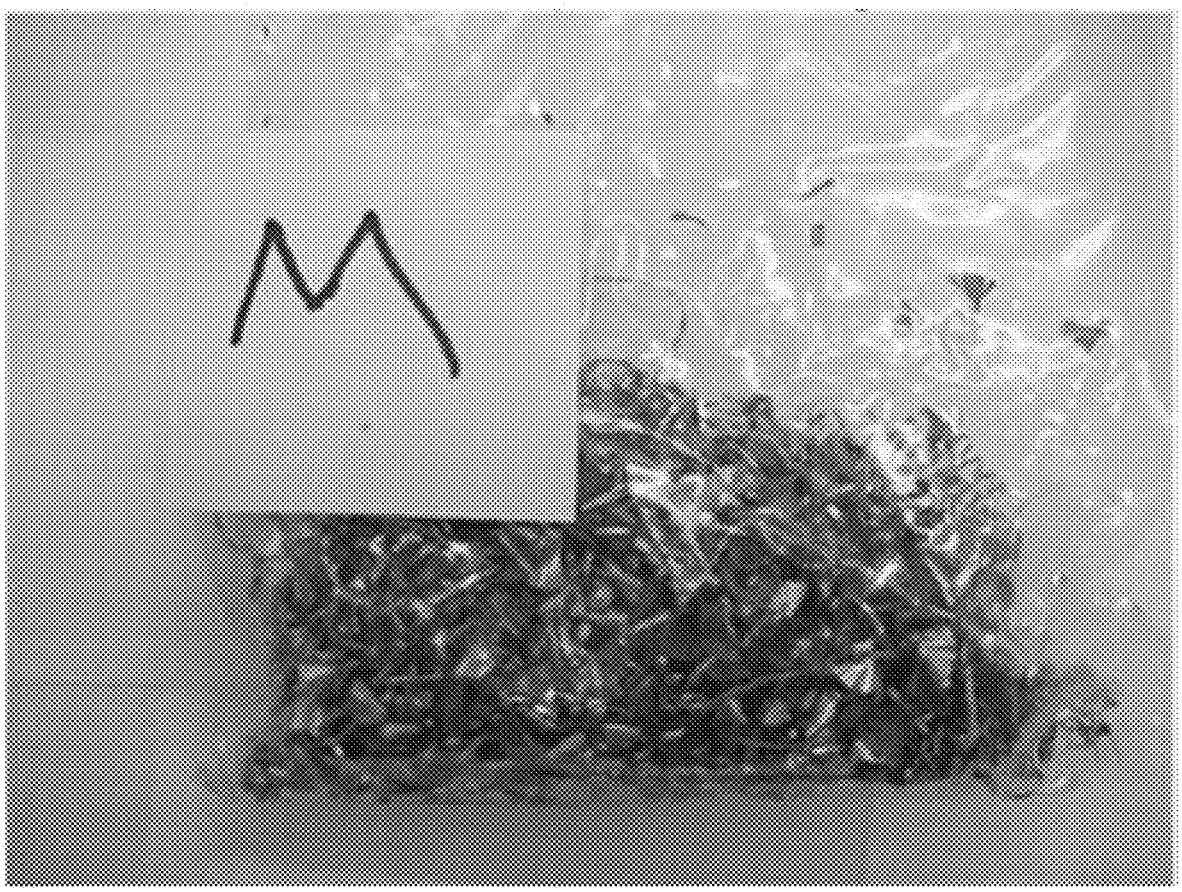
FIG. 22 is a photograph showing short chips of all three chips shapes from Sample M.
Figure 23:
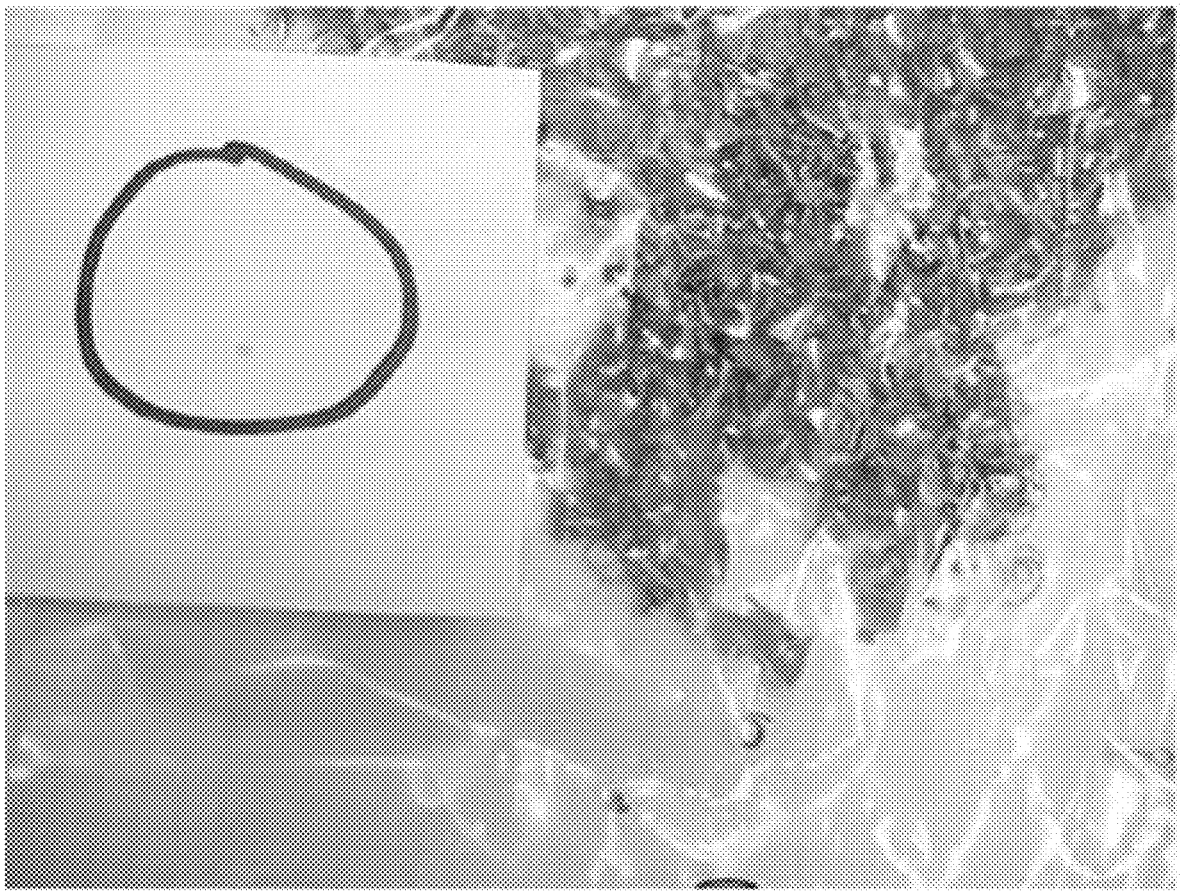
FIG. 23 is a photograph showing short chips of all three chips shapes from Sample O.
Figure 24:
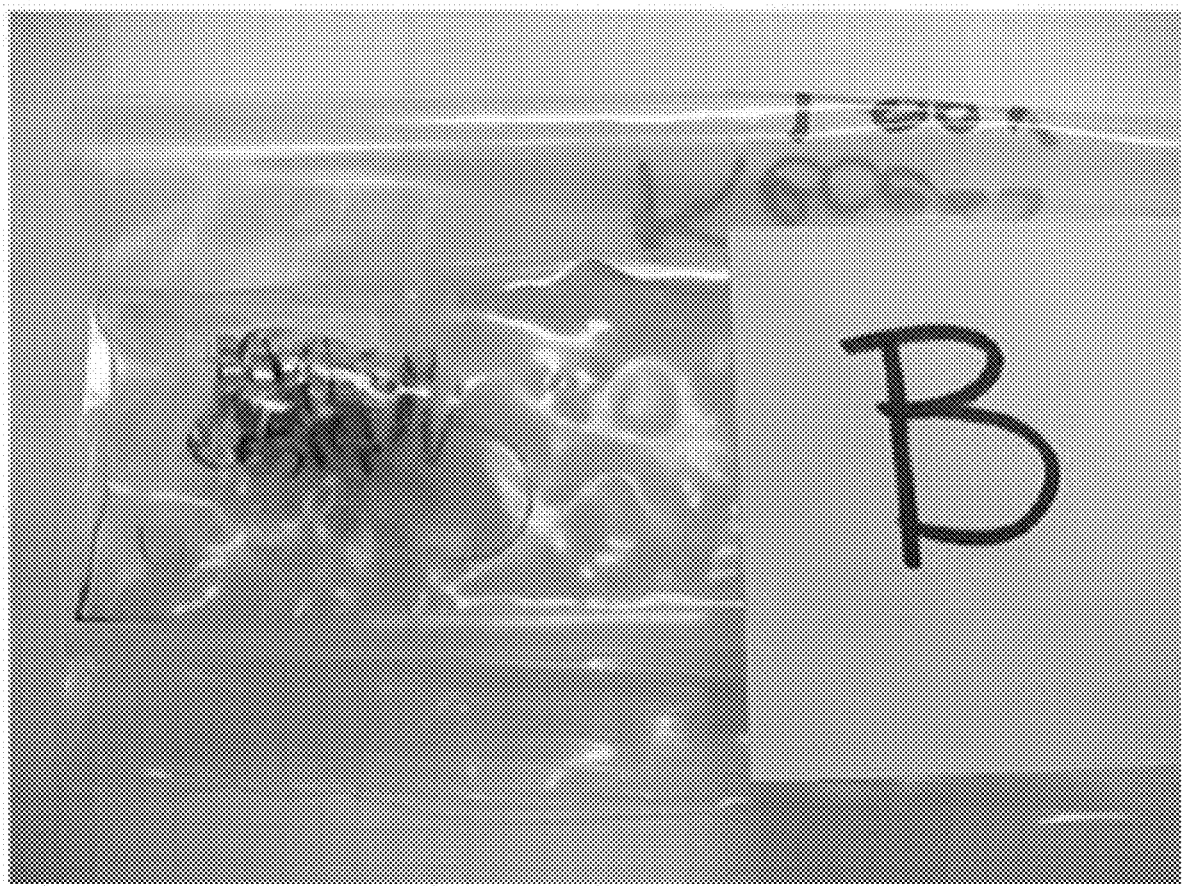
FIG. 24 is a photograph showing ribbon chip fragments from Sample B.
Figure 25:
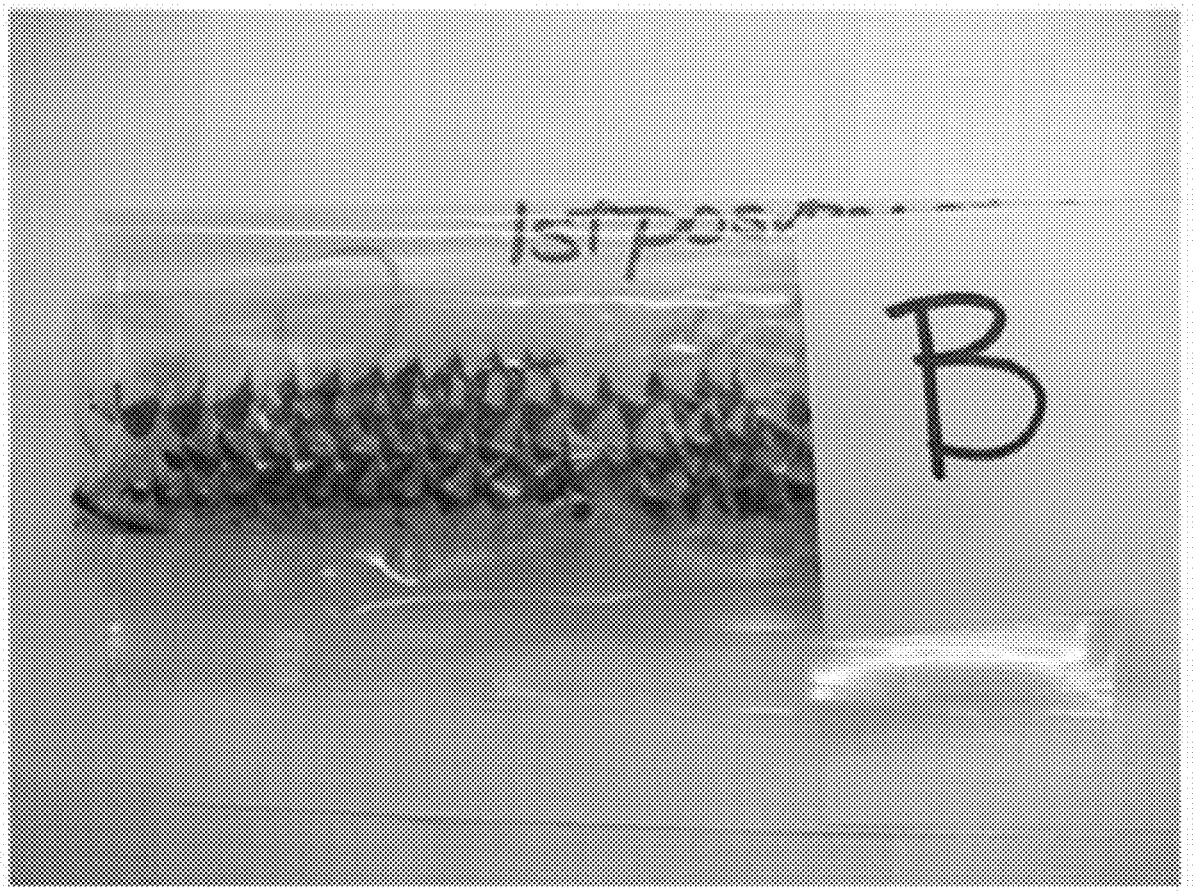
FIG. 25 is a photograph of drill chips from Sample B.
Figure 26:
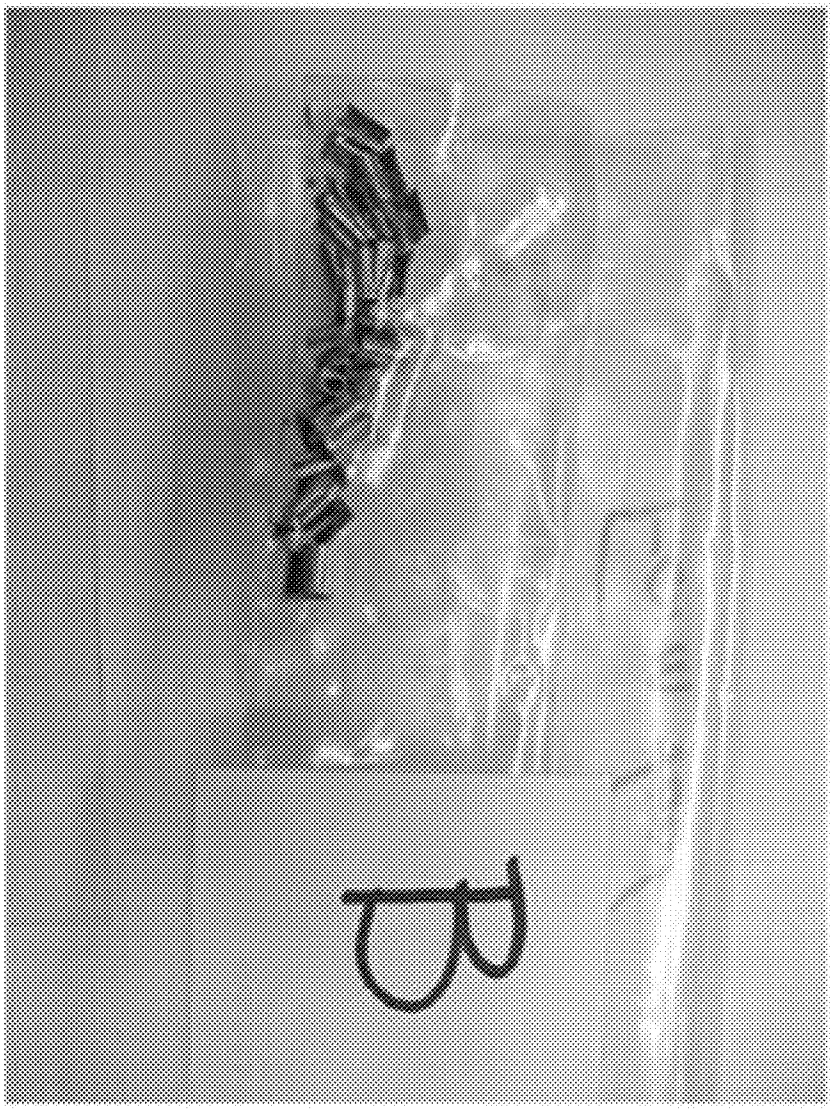
FIG. 26 is a photograph of form tool chips from Sample B.
Figure 27:
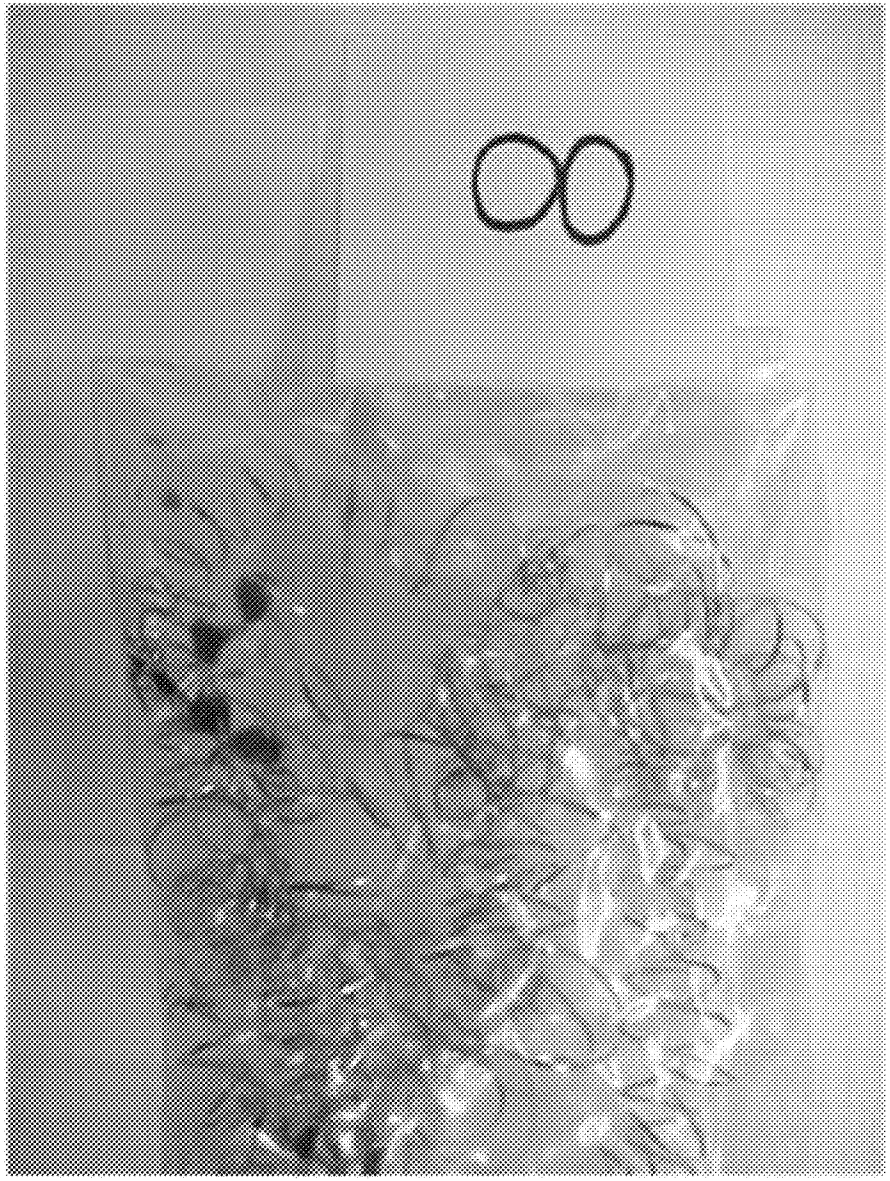
FIG. 27 is a photograph of ribbon and drill chips from Sample −8.
Figure 28:
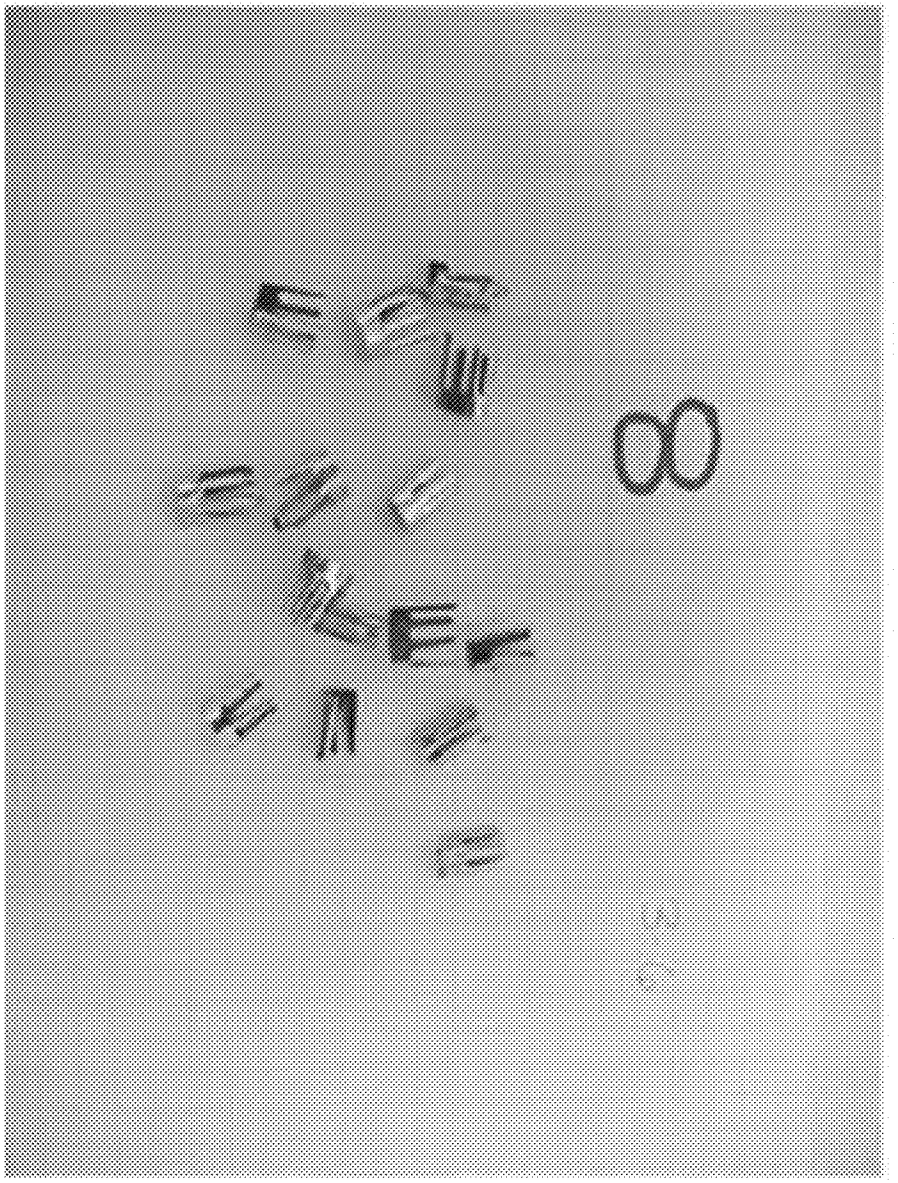
FIG. 28 is a photograph of form tool chips from Sample −8.

Samples M, O, B, and −8 had small and/or readily breakable chips and are shown in FIGS. 22-28, respectively. FIG. 22 shows Sample M. FIG. 23 shows Sample O. Sample M did not pass the corrosion requirement of NSF 14-2012 whereas O was acceptable. Sample O both processed and machined well. FIGS. 24 through 28 are photographs of chips from samples: B (FIGS. 24-26), and –8 (FIGS. 27-28).

Other Alloying Elements

Lead

Lead does not form a solid solution in the matrix of Cu—Zn—Si alloys, but instead disperses to improve machinability, while silicon typically improves machinability by producing non-alpha phases in the structure of metal. Lead can optionally be added to improve machinability, preferably in amounts of at least 0.005 weight percent, and more preferably in amount of at least 0.02 weight percent. The addition of lead in an amount exceeding 0.5 weight percent can have an adverse effect, resulting in a rough surface condition, poor hot workability such as poor forging behavior, and low cold ductility. Moreover, maintaining the lead content below 0.5 weight percent complies with many of the lead-related regulations. More stringent regulations have a limit of 0.25 weight percent and some lower than 0.1 weight percent.

Antimony and Arsenic

Antimony and arsenic in small quantities can be effective in improving the dezincification corrosion resistance and other properties. Preferably these elements are present in amounts of at least 0.02 weight percent. However, the addition of antimony and/or arsenic in excess of 0.15 weight percent does not produce results in proportion to the excess quantity added. Rather, it can negatively affect the hot forgeability and extrudability.

Phosphorus

Phosphorus is similar to antimony and arsenic in that small quantities can be effective in improving dezincification corrosion resistance and other properties. Phosphorus is preferred in some applications to antimony and arsenic due to potential toxicity concerns. Preferably phosphorous is present in amounts of at least 0.02 weight percent. However, the addition of phosphorus in excess of 0.15 percent by weight does not produce results in proportion to the excess quantity added. Rather, it can negatively affect the hot forgeability and extrudability.

Tin

Tin is effective in facilitating the formation of non-alpha phases and works like silicon to improve the machinability of Cu—Zn—Si alloys. Thus, tin when present, can further improve machinability of Cu—Zn—Si alloys. Tin can also improve corrosion resistance, especially against erosion corrosion, dezincification corrosion, and copper leachability. Generally, if present, the tin content should be at least about 0.1 weight percent in order to achieve positive effects against corrosion. However, when tin content exceeds 1.2 weight percent, excess tin can reduce ductility of the alloy, so cracks occur more easily when cast. Thus, tin content is preferably less than 1.2 weight percent, and more preferably between 0.2 and to 0.8 weight percent.

Aluminum

Aluminum is effective in facilitating the formation of non-alpha phases and works like silicon to improve the machinability of Cu—Zn—Si alloys. Aluminum can also be effective in improving the strength, wear resistance, and high-temperature oxidation resistance as well as the machinability of a Cu—Zn—Si alloy. Aluminum also helps keep down the specific gravity of the alloy. Generally, aluminum additions in excess of about 2.5 percent by weight do not produce proportional results. Furthermore, aluminum in excess of 2.5 percent by weight can lower the ductility of the metal alloy without contributing further to the machinability. Additionally, aluminum can decrease the corrosion resistance. For example, sample M5S with 0.825% aluminum had a longitudinal depth of penetration of 800 μm on the ISO6509 test. Due to corrosion concerns, when aluminum is present in excess of 0.5%, the copper content is preferably maintained above 69%.

In some embodiments there may be up to about 1.2 weight percent tin, and preferably up to about 0.8 weight percent tin, and less than about 0.8 weight percent tin, and less than 0.1 weight percent aluminum. In some embodiments there is up to about 2.5 weight percent aluminum and less than 0.1 weight percent tin. In still other embodiments there is less than about 0.1 weight percent of both tin and aluminum.

Bismuth, Tellurium, and Selenium

Bismuth, tellurium, and selenium, like lead, do not form a solid solution with the matrix but disperse to enhance machinability. Thus, one or more of bismuth, tellurium, and selenium can be added to improve machinability. Generally additions of bismuth, tellurium, or selenium in an amount of less than 0.02 percent by weight do not show significant effect on machinability. However, these elements are expensive (compared with copper) and additions in excess of 0.4 percent by weight generally do not pay off economically. Furthermore, with additions of more than 0.4 percent by weight, the alloy can deteriorate in hot workability such as forgeability and cold workability such as ductility. Generally, if present, it is desired to keep the combined content of bismuth, tellurium, or selenium to not higher than about 0.4 percent by weight, to avoid deterioration in hot workability and cold ductility.

Nickel, Manganese, Iron, and Cobalt

Nickel, manganese, iron, and cobalt are known to form second phase intermetallic compounds which remove silicon from solid solution. Silicon is important to providing improved stress corrosion cracking resistance as well as good machinability. Iron up to at least about 0.5 weight percent, and nickel, manganese, and cobalt up to at least about 0.25 weight percent each have not been found to have an adverse effect on alloy performance, and allow the use of a varied scrap stream in commercially making the alloy. However is it preferred to keep the manganese and cobalt less than 0.1 weight percent. If present, these elements can provide grain refinement. Above these amounts increased tool wear can be experienced in some types of machining operations.

Sulfur

Sulfur can be present up to at least about 0.6 weight percent, but is preferably no more than about 0.25 weight percent.

Zirconium and Other Grain Refiners and Oxidizers

Figure 29:
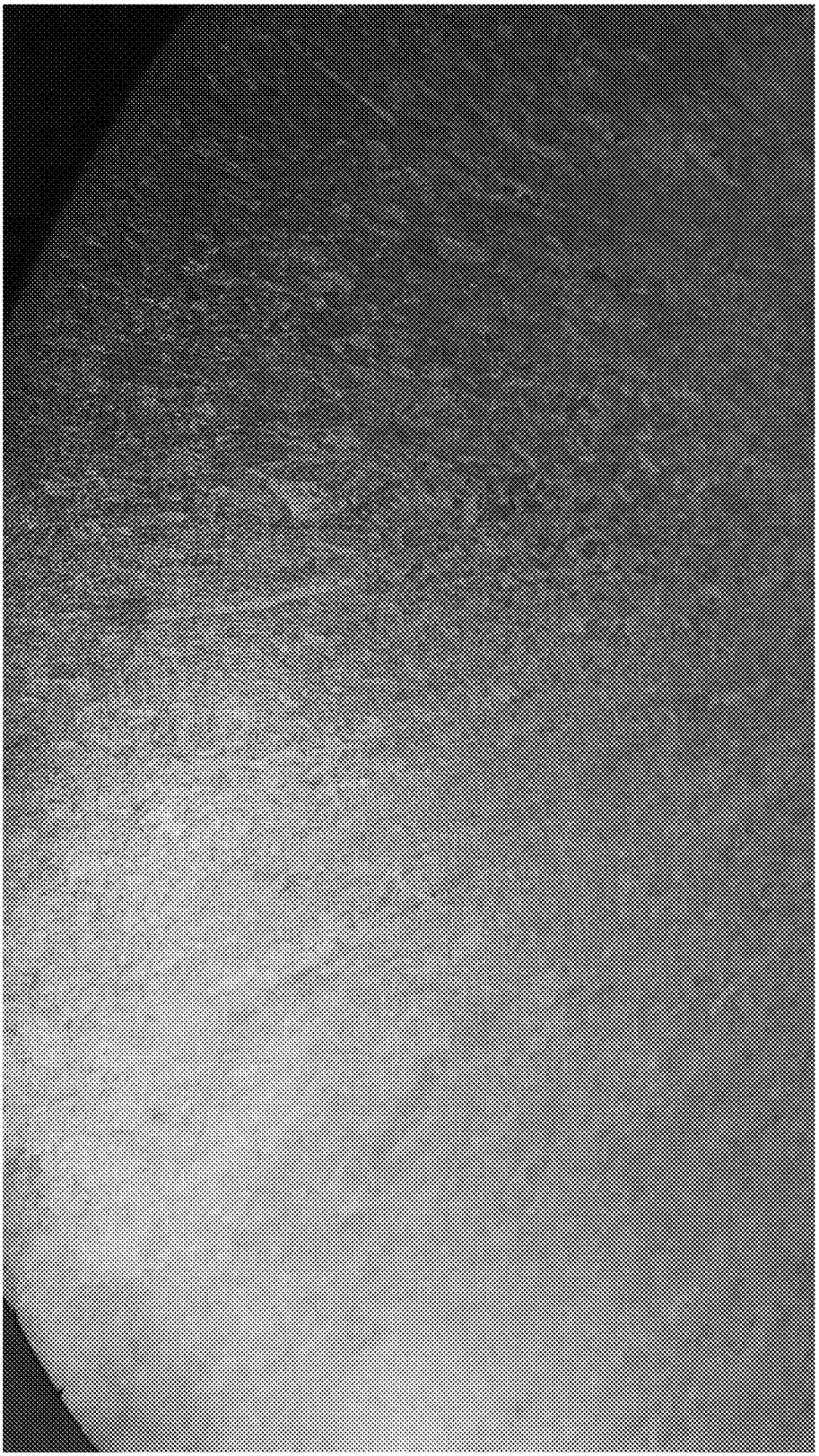
FIG. 29 is a photograph of a billet of Sample R0 without a cast grain refiner, showing some columnar cast grains aligned with surface to center direction.
Figure 30:
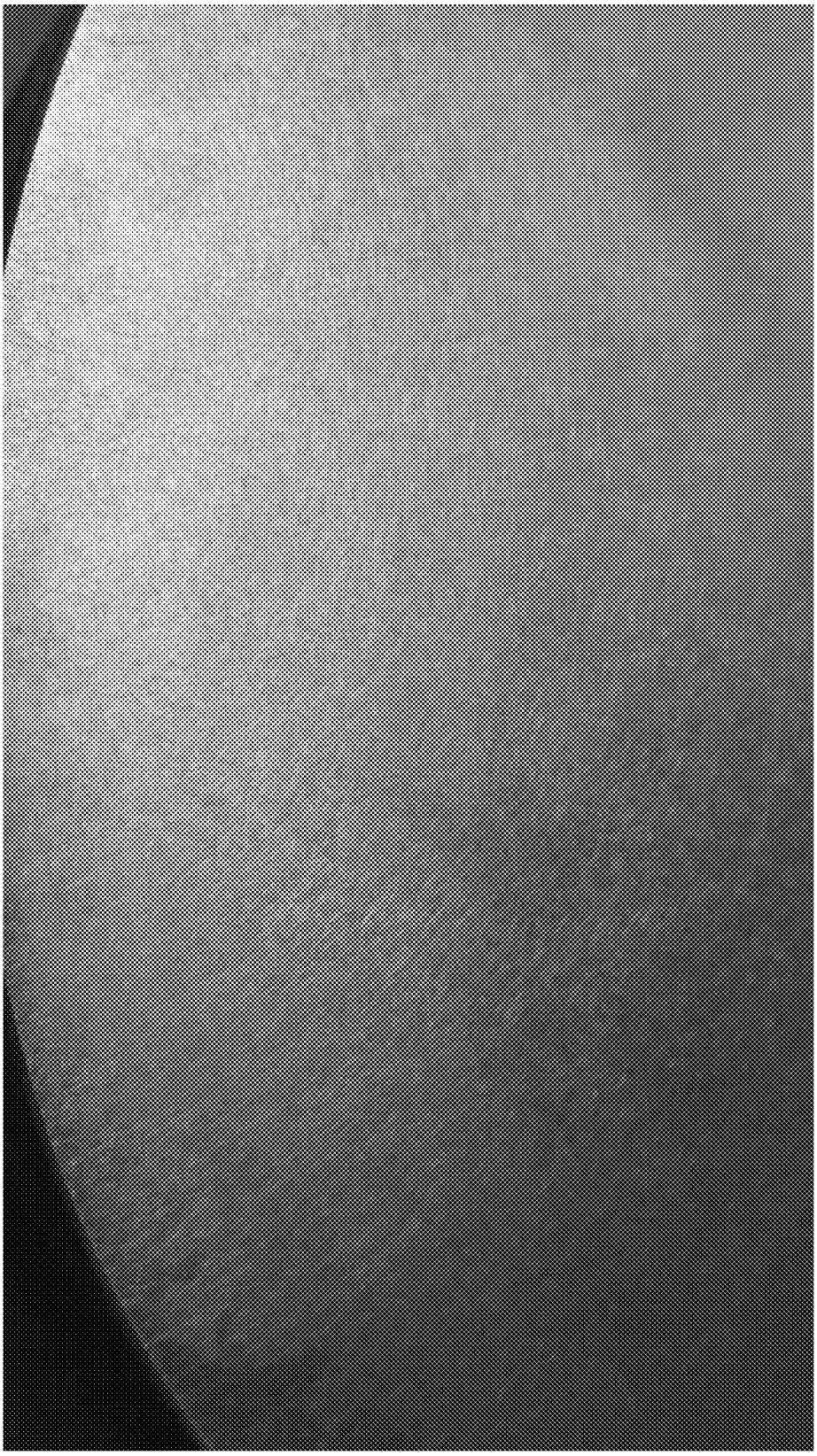
FIG. 30 is a photograph of a billet of Sample R1 with a cast grain refiner (zirconium), showing fine equi-axed cast grains.
Figure 31:
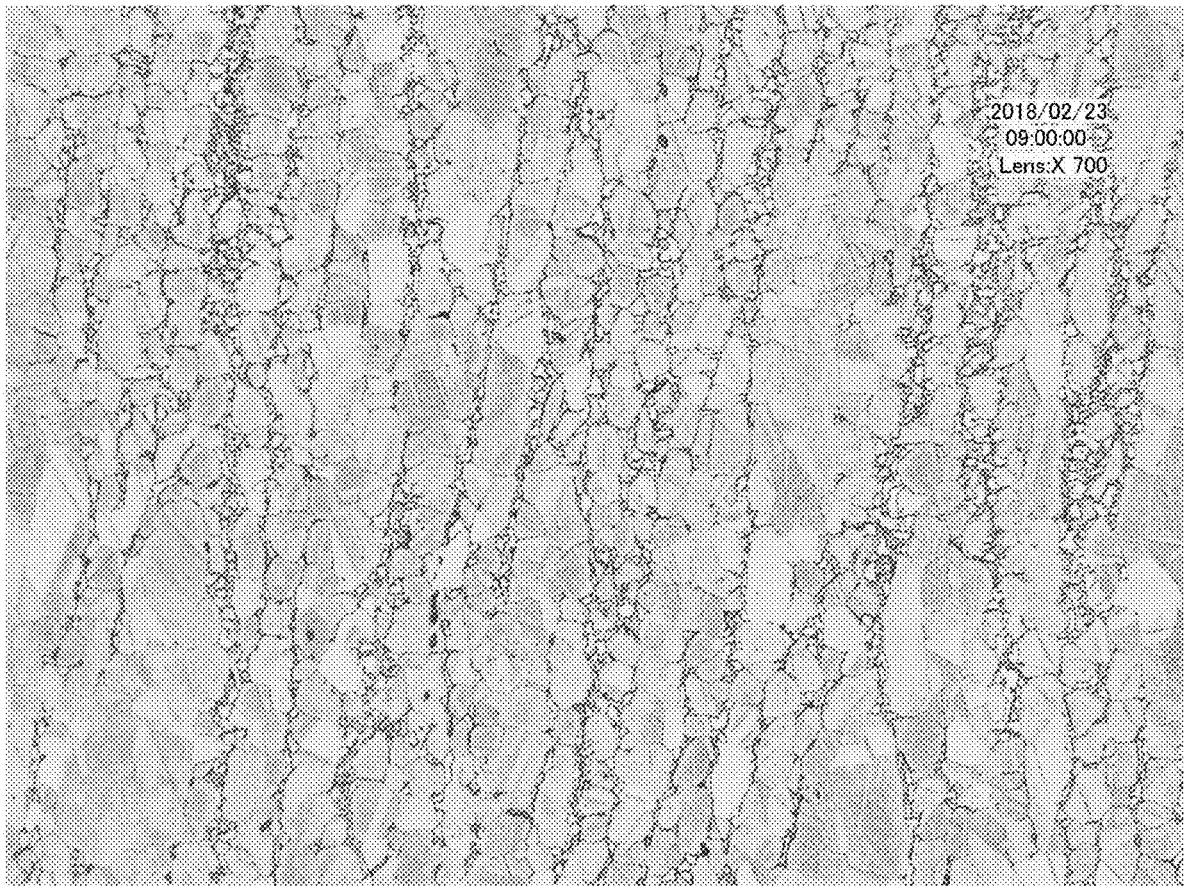
FIG. 31 is a photomicrograph of Sample R0.
Figure 32:
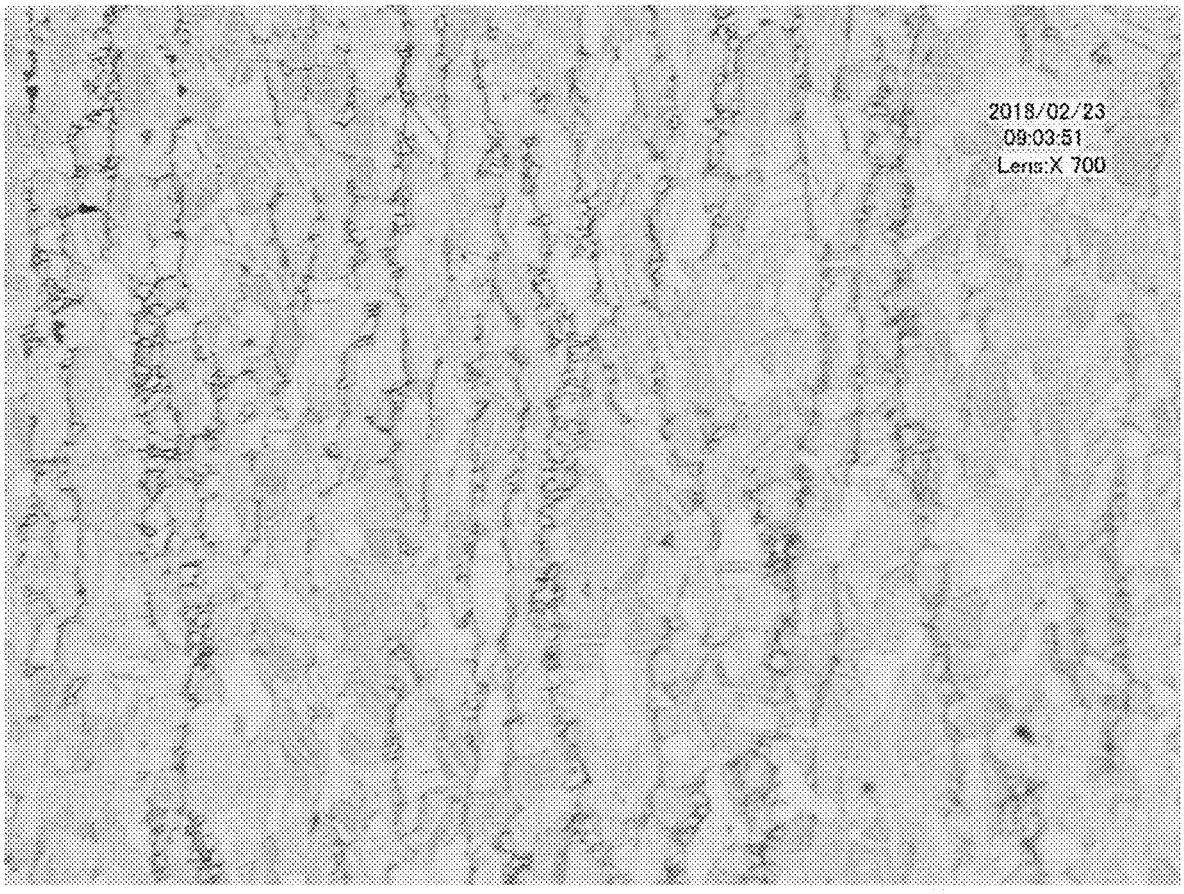
FIG. 32 is a photomicrograph of Sample R1.

These results can be achieved without the need for casting grain refining additions, such as zirconium and boron, which are required in other alloys, although in appropriate cases such grain refiners can be used. FIG. 29 is the macrostructure of cast billet R0 without the addition of a grain refining element showing columnar grains. FIG. 30 is the macrostructure of cast billet R1 showing grain refinement. FIGS. 31 and 32 show the microstructure of the wrought product. Zirconium is capable of grain refining castings used in the creation of the wrought product form. Zirconium, boron, and lithium strongly deoxidize the melt and improve cleanliness. Thin hot rolled plated samples containing: lithium (sample J2), and boron (sample J4) were produced and properties compared to the base alloy without these additions (sample J1). Claimed alloy properties of less than 200 μm of dezincification depth along with other properties are maintained provided that excessive amounts are not present. The benefits are believed to moderate with continued addition, and provide no additional effectiveness above a certain amount.

Zirconium may be present up to 0.1%, preferably up to 0.04%, and if present preferably at least 0.0005%. Boron may be present up to 0.02%, preferably up to 0.01%, and if present preferably at least 0.0005%. Lithium may be present up to 0.1%, preferably up to 0.05%, and if present preferably at least 0.0005%.

Mischmetal

Mischmetal is a mixture of rare earth metals which comprise the lanthanide series elements Nos. 58-71 on the Periodic Table, and in particular elements 58-61, and is capable of grain refining castings used in the creation of the wrought product form. A typical mischmetal composition is cerium 50%, lanthanum 27%, neodymium 16%, praseodymium 5% and other rare earth metals 2%. As used in this application, the term mischmetal is intended to include any material comprised predominantly of lanthanide series elements regardless of the relative proportions thereof. For example, cerium alone could be used in place of mischmetal and would provide equally satisfactory results. Mischmetal deoxidizes the melt and improves cleanliness. A thin hot rolled plated sample containing: mischmetal (sample J3) was produced and properties compared to the base alloy without the addition (sample J1). Claimed alloy properties of less than 200 μm of dezincification depth along with other properties are maintained provided that excessive amounts are not present. The benefits are believed to moderate with continued addition, and provide no additional effectiveness above a certain amount. Mischmetal may be present up to 0.5%, preferably up to 0.3%, and if present at least 0.01%.

Chromium

Chromium forms dispersed second phase particles that provide grain refinement in the wrought product, contribute to improved machinability, and confer improved abrasion and wear resistance. Claimed alloy properties of less than 200 μm of dezincification depth and good machinability are maintained provided that excessive amounts are not present. However, when present in excess chromium can cause premature tool wear. Chromium may be present up to 0.2%, preferably up to 0.1%, and if present at least 0.01%.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A wrought machinable, dezincification-resistant, low lead, low copper, silicon, zinc alloy consisting of between about 66 weight percent and 69 weight percent copper; greater than 1.53 weight percent and less than 2 weight percent silicon wherein the silicon content further satisfies the equation $0.167*Cu-9.28>Si>0.132*Cu-7.66$; up to about 0.25 weight percent lead; up to about 0.15 weight percent phosphorus; up to about 0.5 weight percent iron; up to about 1.2 weight percent tin; up to about 2.5 weight percent aluminum; up to about 0.25 weight percent nickel; up to about 0.25 weight percent cobalt; up to about 0.15 weight percent arsenic; up to about 0.15 weight percent antimony; up to about 0.25 weight percent bismuth; up to about 0.25 weight percent selenium; up to 0.25 weight percent sulfur; and at least one of: up to 0.4 tellurium; up to 0.1 weight percent zirconium; up to 0.2 weight percent chromium; and at least one of: up to 0.1 weight percent lithium; up to 0.2 weight percent boron; and up to about 0.5 weight percent mischmetal; and the balance zinc and unavoidable impurities, wherein the alloy has been worked and heated sufficiently to produce a microstructure with a corrosion penetration 200 μm tested according to ISO 6509 Protocol.

2. The wrought machinable, dezincification-resistant, low lead, low copper, silicon, zinc alloy of claim 1 wherein there is at least 0.0005 weight percent zirconium.

3. The wrought machinable, dezincification-resistant, low lead, low copper, silicon, zinc alloy of claim 1 wherein there is at least 0.01 weight percent chromium.

4. The wrought machinable, dezincification-resistant, low lead, low copper, silicon, zinc alloy of claim 1 wherein there is at least 0.02 weight percent tellurium.

5. The wrought machinable, dezincification-resistant, low lead, low copper, silicon, zinc alloy of claim 1 wherein there is at least 0.0005 weight percent boron.

6. The wrought machinable, dezincification-resistant, low lead, low copper, silicon, zinc alloy of claim 1 wherein there is at least 0.0005 weight percent lithium.

7. The wrought machinable, dezincification-resistant, low lead, low copper, silicon, zinc alloy of claim 1 wherein there is at least 0.01 weight percent mischmetal.

* * * * *